US009389025B2

(12) United States Patent
Lowenstein

(10) Patent No.: US 9,389,025 B2
(45) Date of Patent: Jul. 12, 2016

(54) HEAT AND MASS EXCHANGERS HAVING EXTRUDED PLATES

(75) Inventor: Andrew Lowenstein, Hopewell, NJ (US)

(73) Assignee: AIL RESEARCH INC., Hopewell, NJ (US)

( * ) Notice: Subject to any disclaimer, the term of this patent is extended or adjusted under 35 U.S.C. 154(b) by 261 days.

(21) Appl. No.: 14/125,056

(22) PCT Filed: Jun. 8, 2012

(86) PCT No.: PCT/US2012/041661

§ 371 (c)(1), (2), (4) Date: Apr. 7, 2014

(87) PCT Pub. No.: WO2012/170887

PCT Pub. Date: Dec. 13, 2012

(65) Prior Publication Data

US 2015/0292811 A1 Oct. 15, 2015

Related U.S. Application Data

(60) Provisional application No. 61/494,676, filed on Jun. 8, 2011, provisional application No. 61/612,735, filed on Mar. 19, 2012.

(51) Int. Cl.
*F28D 21/00* (2006.01)
*F28F 13/06* (2006.01)
(Continued)

(52) U.S. Cl.
CPC ..... *F28D 21/0015* (2013.01); *F28D 5/00* (2013.01); *F28D 9/0081* (2013.01); *F28F 13/06* (2013.01); *F28F 21/065* (2013.01)

(58) Field of Classification Search
CPC ..... F28D 21/00; F28D 21/0015; F28D 2021/0038; F28D 2021/0061; F28D 2021/0068; F28D 2021/0077
USPC ..... 62/304, 121, 171
See application file for complete search history.

(56) References Cited

U.S. PATENT DOCUMENTS 4,162,146 A * 7/1979 Seibert ..... B01D 53/04 96/113
4,255,940 A * 3/1981 Grahl ..... F25B 43/003 62/324.3

(Continued)

OTHER PUBLICATIONS

International Search Report of PCT/US2012/041661 dated Sep. 14, 2012.

(Continued)

*Primary Examiner* — Mohammad M Ali
(74) *Attorney, Agent, or Firm* — Amster, Rothstein & Ebenstein LLP

(57) ABSTRACT

A heat and mass exchanger including a plurality of vertical plates that are spaced apart from one another by gaps so as to allow a first gas to flow between the plates. Each plate includes a front wall that defines a front surface of the plate, a back wall that defines a back surface of the plate, and separate, parallel channels disposed between the front and back walls. The parallel channels include a first set of parallel channels, a first liquid flowing within the first set of channels and over one of the front or back surfaces of the plate, the first liquid having a bulk composition comprising one or more constituents, the first gas having at least one constituent in common with the first liquid, and a second set of parallel channels, a first fluid flowing within the second set of channels.

34 Claims, 14 Drawing Sheets

(51) Int. Cl.

| | |
|---|---|
| ***F28F 21/06*** | (2006.01) |
| ***F28D 5/00*** | (2006.01) |
| ***F28D 9/00*** | (2006.01) |

(56) References Cited

U.S. PATENT DOCUMENTS

| | | | | | |
|---|---|---|---|---|---|
| 4,322,223 | A * | 3/1982 | Christel, Jr. | B01D 53/0454 | 95/105 |
| 5,288,469 | A * | 2/1994 | Skalla | A61B 18/00 | 261/DIG. 26 |
| 5,617,913 | A * | 4/1997 | DeGregoria | A61M 16/1045 | 128/201.13 |
| 5,640,783 | A * | 6/1997 | Schumaier | A61L 2/07 | 34/219 |
| 5,678,377 | A * | 10/1997 | Leopold | E06B 3/6675 | 52/314 |
| 5,758,401 | A * | 6/1998 | Nelson | G11B 23/0233 | 29/428 |
| 5,852,879 | A * | 12/1998 | Schumaier | A61L 2/07 | 34/218 |
| 5,901,464 | A * | 5/1999 | Kazakis | B01D 45/16 | 34/562 |
| 5,930,910 | A * | 8/1999 | Trapp | B01D 53/0415 | 34/80 |
| 6,354,248 | B1 * | 3/2002 | Bourke | F24H 1/205 | 122/155.2 |
| 7,213,412 | B2 * | 5/2007 | Kent | F25B 39/04 | 62/509 |
| 7,275,390 | B2 * | 10/2007 | Evans | B01D 53/0415 | 62/474 |
| 7,601,193 | B2 * | 10/2009 | Scherrer | B01D 45/08 | 55/440 |
| 9,079,658 | B2 * | 7/2015 | Smith | B64C 23/06 | |
| 9,101,875 | B2 * | 8/2015 | Vandermeulen | F28F 1/02 | |
| 2003/0029185 | A1 | 2/2003 | Kopko | | |
| 2004/0060444 | A1 * | 4/2004 | Smith | B01D 53/0415 | 96/108 |
| 2004/0079047 | A1 * | 4/2004 | Peterson | E06B 3/66314 | 52/786.13 |
| 2005/0229628 | A1 * | 10/2005 | Evans | B01D 53/0415 | 62/474 |
| 2006/0156750 | A1 | 7/2006 | Lowenstein et al. | | |
| 2006/0185294 | A1 * | 8/2006 | Langer | E06B 3/667 | 52/456 |
| 2006/0242993 | A1 * | 11/2006 | Kent | F25B 39/04 | 62/509 |
| 2006/0283159 | A1 * | 12/2006 | Scherrer | B01D 45/08 | 55/434 |
| 2008/0173590 | A1 | 7/2008 | Duesel et al. | | |
| 2010/0218301 | A1 * | 9/2010 | Messiou | A41D 27/28 | 2/115 |
| 2010/0264153 | A1 * | 10/2010 | Bellamah | B65F 83/0463 | 220/737 |
| 2010/0319370 | A1 | 12/2010 | Kozubal et al. | | |
| 2011/0108406 | A1 | 5/2011 | Maisotsenko et al. | | |

OTHER PUBLICATIONS

Written Opinion of International Application PCT/US2012/041661 dated Sep. 14, 2012.

* cited by examiner

HEAT AND MASS EXCHANGERS HAVING EXTRUDED PLATES

GOVERNMENT INTEREST

This invention was made with Government support under Subcontract No. AXL-1-11896 awarded by the National Renewable Energy Laboratory. The Government has certain rights in this invention.

RELATED APPLICATIONS

This application is a U.S. National Phase of PCT/US2012/041661 which is based on U.S. Provisional Application 61/494,676, filed on Jun. 8, 2011 and U.S. Provisional Application 61/612,735, filed on Mar. 19, 2012, and are now both expired, the contents of which are incorporated herein by reference in their entirety.

FIELD OF THE INVENTION

This invention is directed to heat and mass exchangers, and in particular to heat and mass exchangers made up of extruded plates.

BACKGROUND OF THE INVENTION

As the HVAC industry meets the rapidly expanding demand for comfort conditioning, it faces challenges created by the high energy and electricity demands of vapor-compression cooling systems. The industry also faces challenges from the need to better control indoor humidity. In many applications, desiccant systems, which can dry air without first cooling the air below its dewpoint temperature and run mostly on thermal energy, will address these challenges.

Desiccant systems fall into two categories: those that use solid desiccant rotors and those that circulate a liquid desiccant over a porous bed of contact media. The liquid desiccant systems can be more efficient than their solid desiccant counterparts, but solid desiccant systems traditionally have had lower maintenance requirements. The higher maintenance requirements for the liquid desiccant systems are often caused by the corrosiveness of the liquid desiccant, which usually is a strong salt solution. Maintenance problems can develop if droplets of the liquid desiccant become entrained in the flow of air that is being dried.

As described in U.S. Pat. No. 6,848,265, the contents of which are incorporated herein by reference in their entirety, one approach to ensuring that droplets of desiccant are not entrained in the flow of air is to apply a hydrophilic wick to the surface of the contact media and then flow the liquid desiccant within this wick. Alternatively, membranes (such as Nafion®, manufactured by DuPont, of Wilmington, Del., USA) and hydrophobic, microporous films (such as those manufactured by Celgard, of Charlotte, N.C., USA) have been used to isolate the liquid desiccant from the flow of air while still allowing the desiccant to absorb water vapor from the air. U.S. Pat. Nos. 5,528,905 and 6,684,649, PCT Application Publication No. WO 2009/094032 A, and Conde-Petit, et al., "Open Absorption System for Cooling and Air Conditioning Using Membrane Contactors," Final Report, Project No. 10131, Im Auftrag des Bundesamt für Energie, Forschungsprogramm Energie in Gebäuden, July 2008 have all demonstrated air conditioning systems in which a liquid desiccant flows on one side of a membrane or hydrophobic, microporous film and the air that is to be dehumidified flows on the other side.

U.S. Pat. No. 4,194,041 discloses an invention in which a hydrophilic wicking layer is laminated to a hydrophobic membrane. U.S. Pat. No. 6,849,184 uses a membrane that is backed by a hydrophilic layer that wicks the liquid towards the membrane. Although U.S. Pat. No. 6,849,184 was applied to a system for desalinating seawater, a review paper of liquid desiccant technology shows a conceptual drawing of a liquid-desiccant contactor proposed by American Energy Exchange (AEX) in which the liquid desiccant flows in a wick that is separated from the process air by a membrane (Conde-Petit, "Liquid Desiccant-Based Air Conditioning Systems", 1st European Conference on Polygeneration, Tarragona, Spain, October 2007; FIG. 10).

SUMMARY OF THE INVENTION

According to an exemplary embodiment of the present invention, a heat and mass exchanger that exchanges heat and/or mass between a first gas stream and a first liquid stream while simultaneously heating or cooling the first liquid stream comprises: a plurality of vertical plates that are spaced apart from one another by gaps so as to allow a first gas to flow between the plates, each plate comprising: a front wall that defines a front surface of the plate; a back wall that defines a back surface of the plate; and parallel channels disposed between the front and back walls, each parallel channel being separated from a neighboring channel over at least a portion of the total length of the channel by a web, the parallel channels comprising: a first set of parallel channels, a first liquid flowing within the first set of channels and over one of the front or back surfaces of the plate, the first liquid having a bulk composition comprising one or more constituents, the first gas having at least one constituent in common with the first liquid; and a second set of parallel channels, a first fluid flowing within the second set of channels.

According to at least one embodiment, the channels are oriented vertically.

According to at least one embodiment, the channels are oriented horizontally.

According to at least one embodiment, at least one of the plurality of plates further comprises: one or more supply orifices disposed in one of the front or back walls of the plate, the one or more supply orifices supplying the first liquid to the one of the front or back surfaces of the plate from the first set of channels.

According to at least one embodiment, the at least one of the plurality of plates comprises a first supply orifice disposed in the front wall of the plate and a second supply orifice disposed in the back wall of the plate, the first supply orifice being in communication with channels from the first set of parallel channels that are different from channels from the first set of parallel channels that are in communication with the second supply orifice.

According to at least one embodiment, the at least one of the plurality of plates comprises: one or more removal orifices disposed in one of the front or back walls of the plate, the first liquid flowing from the one of the front or back surfaces of the plate to the first set of channels through the one or more removal orifices.

According to at least one embodiment, the channels in the first set of channels that supply the first liquid to the one or more supply orifices are different from channels in the first set of channels that receive the first liquid from the one or more removal orifices.

According to at least one embodiment, at least one channel in the first set of channels that supply the first liquid to the one or more supply orifices also receives the first liquid from the one or more removal orifices, and the at least one channel is modified so that the first liquid cannot flow within the at least one channel between the one or more supply orifices and the one or more removal orifices.

According to at least one embodiment, the at least one plate further comprises a membrane that separates the first liquid that flows over the one of the front or back surfaces of the plate from the first gas that flows in the gaps between the spaced apart plates, the membrane preventing portions of the bulk composition of the first liquid from entering the flow of first gas while allowing one or more constituents of the first liquid and first gas to be exchanged.

According to at least one embodiment, a periphery of the membrane is sealed to the at least one plate so that the one or more supply orifices and the one or more removal orifices are covered by the membrane.

According to at least one embodiment, at least one of the plurality of plates comprises a wick within which the first liquid flows over the one of the front or back surfaces of the plate.

According to at least one embodiment, at least one of the plurality of plates further comprises a means for spreading the first liquid over the one of the front or back surfaces of the plate.

According to at least one embodiment, the means for spreading comprises a membrane that is intermittently bonded to the plate across the one of the front or back surfaces of the plate.

According to at least one embodiment, the means for spreading comprises a spreader insert having a pattern of recesses that directs the first liquid from the one or more supply orifices to a plurality of discrete locations across the one of the front or back surfaces of the plate.

According to at least one embodiment, the heat and mass exchanger further comprises a covering disposed over the one or more removal orifices, the covering comprising means for directing the first liquid towards the one or more removal orifices.

According to at least one embodiment, the means for directing comprises at least one of a wick, an insert or a woven screen.

According to at least one embodiment, the means for directing comprises protuberances or recesses formed in the covering.

According to at least one embodiment, the at least one plate comprises a wick within which the first liquid flows over the one of the front or back surfaces of the plate, at least a portion of the wick being disposed between the covering and the one of the front or back surfaces of the plate.

According to at least one embodiment, the at least one of the plurality of plates further comprises: a supply opening formed in one of the front or back walls through which the first liquid is supplied to the first set of channels for delivery to the supply orifice; and a removal opening formed in one of the front or back walls through which the first liquid is removed from the first set of channels after entry of the first liquid through the removal orifice.

According to at least one embodiment, the at least one of the plurality of plates further comprises: a supply opening formed in a first edge of the plate through which the first liquid is supplied to the first set of channels for delivery to the supply orifice; and a removal opening formed in a second edge of the plate through which the first liquid is removed from the first set of channels after entry of the first liquid through the removal orifice.

According to at least one embodiment, the heat and mass exchanger further comprises a spacer disposed between at least two of the plurality of parallel plates, the spacer maintaining the gap between the at least two parallel plates and mixing the first gas flowing between the at least two parallel plates.

According to at least one embodiment, the spacer comprises: a spine that maintains the gap between the at least two parallel plates, the spine being porous so that the first gas can flow past the spine; and vanes disposed on the spine that create vortices in a flow of the first gas. According to at least one embodiment, the spacer is made from a twin-wall extruded plate with multiple internal webs that define channels within the extruded plate by removing sections of the front and back wall of the extrusion and deforming exposed webs so that each is twisted about an axis that is aligned with the channels.

According to an exemplary embodiment of the present invention, a membrane desalination unit for thermally distilling potable water from impure water comprises: a plurality of vertical plates that are spaced apart from one another by gaps so as to allow impure water to flow between the plates, each plate comprising: a front wall that defines a front surface of the plate; a back wall that defines a back surface of the plate; a membrane disposed over one of the back or front surfaces of the plate, the membrane allowing water vapor to cross but not liquid water; and parallel channels disposed between the front and back walls, each parallel channel being separated from a neighboring channel over at least a portion of the total length of the channel by a web, the parallel channels comprising: a first set of parallel channels, impure water flowing within the first set of channels; and a second set of parallel channels, potable water flowing between the one of the back or front surfaces of the plate and the membrane and collected within the second set of parallel channels.

According to an exemplary embodiment of the present invention, method for exchanging heat and/or mass between a first gas stream and a first liquid stream while simultaneously heating or cooling the first liquid stream comprises the steps of: providing a plurality of vertical plates that are spaced apart from one another by gaps, each plate comprising: a front wall that defines a front surface of the plate; a back wall that defines a back surface of the plate; and parallel channels disposed between the front and back walls, each parallel channel being separated from a neighboring channel over at least a portion of the total length of the channel by a web, the parallel channels comprising: a first set of parallel channels; and a second set of parallel channels; flowing a first gas within the gaps between the plurality of plates; flowing a first liquid within the first set of channels and over one of the front or back surfaces of the plate, the first liquid having a bulk composition comprising one or more constituents, the first gas having at least one constituent in common with the first liquid; and flowing a first fluid within the second set of channels.

According to at least one embodiment, the first liquid is a desiccant.

According to at least one embodiment, the first fluid is a coolant.

According to an exemplary embodiment of the present invention, a vertical plate for use with a heat and mass exchanger that exchanges heat and/or mass between a first gas stream and a first liquid stream while simultaneously heating or cooling the first liquid stream comprises: a front wall that defines a front surface of the plate, a first supply orifice disposed in the front wall of the plate; a back wall that defines a back surface of the plate, a second supply orifice disposed in the back wall of the plate; and parallel channels disposed between the front and back walls, each parallel channel being separated from a neighboring channel over at least a portion of the total length of the channel by a web, the parallel channels comprising: a first set of parallel channels, a first liquid flowing within the first set of channels and through the first and second supply orifices so that the first liquid flows over the front and back surfaces of the plate, the first liquid having a bulk composition comprising one or more constituents, the first gas having at least one constituent in common with the first liquid; and a second set of parallel channels, a first fluid flowing within the second set of channels.

According to an exemplary embodiment of the present invention, a spacer is disposed between at least two parallel surfaces, at least one of the parallel surfaces exchanging heat and/or mass with a first fluid stream that flows between the at least two parallel surfaces, and the spacer comprises: a spine that maintains a gap between the at least two parallel surfaces, the spine being porous so that the first fluid can flow past the spine; and vanes disposed on the spine that create vortices in a flow of the first fluid so as to mix the first fluid.

According to an exemplary embodiment of the present invention, a heat and mass exchanger exchanges heat and/or mass between a first gas stream and a first liquid stream while simultaneously heating or cooling the first liquid stream, the first liquid having a bulk composition comprising one or more constituents, the first gas having at least one constituent in common with the first liquid, and the heat and mass exchanger comprises: a plurality of vertical plates that are spaced apart from one another by gaps, each plate comprising: a front wall that defines a front surface of the plate; a back wall that defines a back surface of the plate; and parallel channels disposed between the front and back walls, each parallel channel being separated from a neighboring channel over at least a portion of the total length of the channel by a web, a first liquid flowing within one or more of the channels; an impermeable surface attached to one of the front or back surfaces of the plate, the impermeable surface comprising: an opening that aligns with an opening in the one of the front or back surfaces and through which the first liquid flows; an overlaying permeable membrane that is attached at its periphery to the impermeable surface, the attached periphery encompassing the opening through which the first liquid flows, the permeable membrane being in contact with the first gas stream; and a cooled or heated surface in contact with the impermeable surface.

BRIEF DESCRIPTION OF DRAWINGS

The features and advantages of the present invention will be more fully understood with reference to the following, detailed description of illustrative embodiments of the present invention when taken in conjunction with the accompanying figures, wherein.

DESCRIPTION OF PREFERRED EMBODIMENTS OF THE INVENTION

A liquid-desiccant heat and mass exchanger (HMX) for cooling and drying an air stream that uses membranes or hydrophobic, micro-porous films will be most effective if the surfaces that bring the liquid desiccant into contact with the air stream (i.e., the contact surfaces) are internally cooled. This then requires that the HMX have three isolated fluid streams flowing through it: (1) the process air that is to be dried and cooled, (2) the liquid desiccant that is to absorb the water vapor from the air, and (3) a coolant that removes the thermal energy that is released as the desiccant absorbs the water vapor. The manifolding of these three fluid streams through the common HMX presents challenges to the designer.

Figure 5:
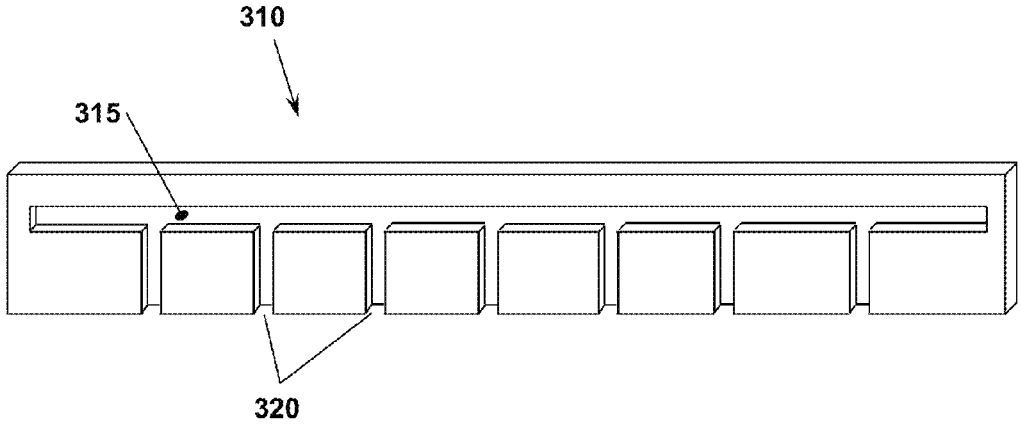
FIG. 5 is a perspective view of a distribution plate according to an exemplary embodiment of the present invention.

Known heat and mass exchangers for liquid desiccant systems are configured as plate-type heat exchangers in which the coolant (either a liquid, gas or mixture of both) flows inside the plates through straight, vertical internal channels separated by thin walls or webs, the liquid desiccant flows on wicks on the outside of the plates, and the process air flows in the gaps between the plates. It has been common in these HMXs to allow the process air to come in direct contact with the desiccant-wetted wicks that are on the surface of the plates. It has also been common to use a desiccant distributor for delivering the liquid desiccant to the wicks that is not an integral part of the HMX's plates. U.S. Pat. No. 6,745,826 teaches a liquid-desiccant HMX with this configuration in which the coolant is a liquid and an end-piece attached to each plate delivers the desiccant to the surface of the plates. This patent also teaches that the plates of the HMX can be flat or curved in a direction that maintains straight internal channels. Similarly, U.S. Provisional Patent Application 61/430,692 teaches that the plates of the HMX can be flat or curved in a direction that also curves the internal channels. Furthermore, U.S. Pat. Nos. 5,638,900; 6,079,481, and 7,269,966 teach that the direction of the coolant flowing within the plates can be changed by permitting neighboring channels to communicate with each other through holes in the walls that separate the channels, as shown in FIG. 13B of U.S. Pat. No. 7,269,966, or cut-outs in the plates that intercept more than one channel, as shown in FIG. 5 of U.S. Pat. No. 5,638,900.

In many applications, the liquid desiccant is a strong salt solution (e.g., a 40% aqueous solution of lithium chloride or calcium chloride). Because these liquid desiccants are corrosive, the plates of the HMX are preferably made from a plastic extrusion which does not corrode.

Figure 1:
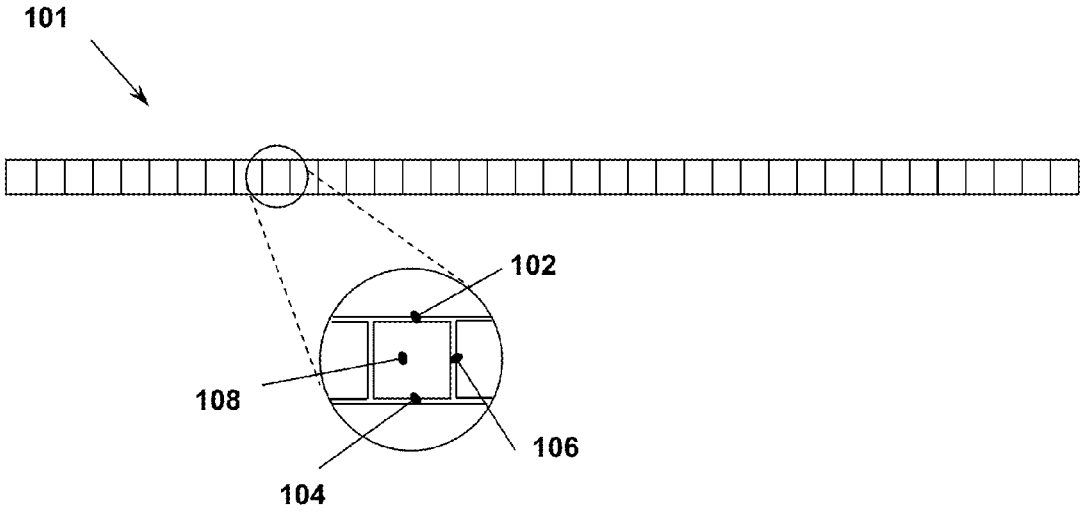
FIG. 1 is a cross-sectional view of a plate used in a heat and mass exchanger according to an exemplary embodiment of the present invention.

FIG. 1 shows a plate, generally designated by reference number 101, for a liquid-desiccant HMX according to an exemplary embodiment of the present invention. The plate 101 may be a twin-wall, polypropylene extruded sheet, such as a sheet manufactured and sold by Coroplast, of Dallas, Tex., USA. The twin-wall extruded plate 101 has a front wall 102, a back wall 104 and webs 106 connecting the two walls. The webs 106 are spaced apart and create channels 108 within the extruded plate that run its length. According to an exemplary embodiment, the plastic extruded plate 101 may be used to make a liquid-desiccant HMX that is evaporatively cooled by a mixture of water and air and may have an overall thickness of 4 mm for the extruded plate, and 0.15 mm thickness for the individual front wall 102, back wall 104, and web 106. The webs 106 may be spaced apart so that there are about 170 channels per meter width of extruded plate. According to another exemplary embodiment, the plastic extruded plate 101 may be used to make a liquid-desiccant HMX that is cooled by water and may have an overall thickness of 2 mm for the extruded plate, and 0.15 mm thickness for the individual front wall 102, back wall 104, and web 106. The webs may be spaced apart so that there are about 350 channels per meter width of extruded plate.

Figure 2A:
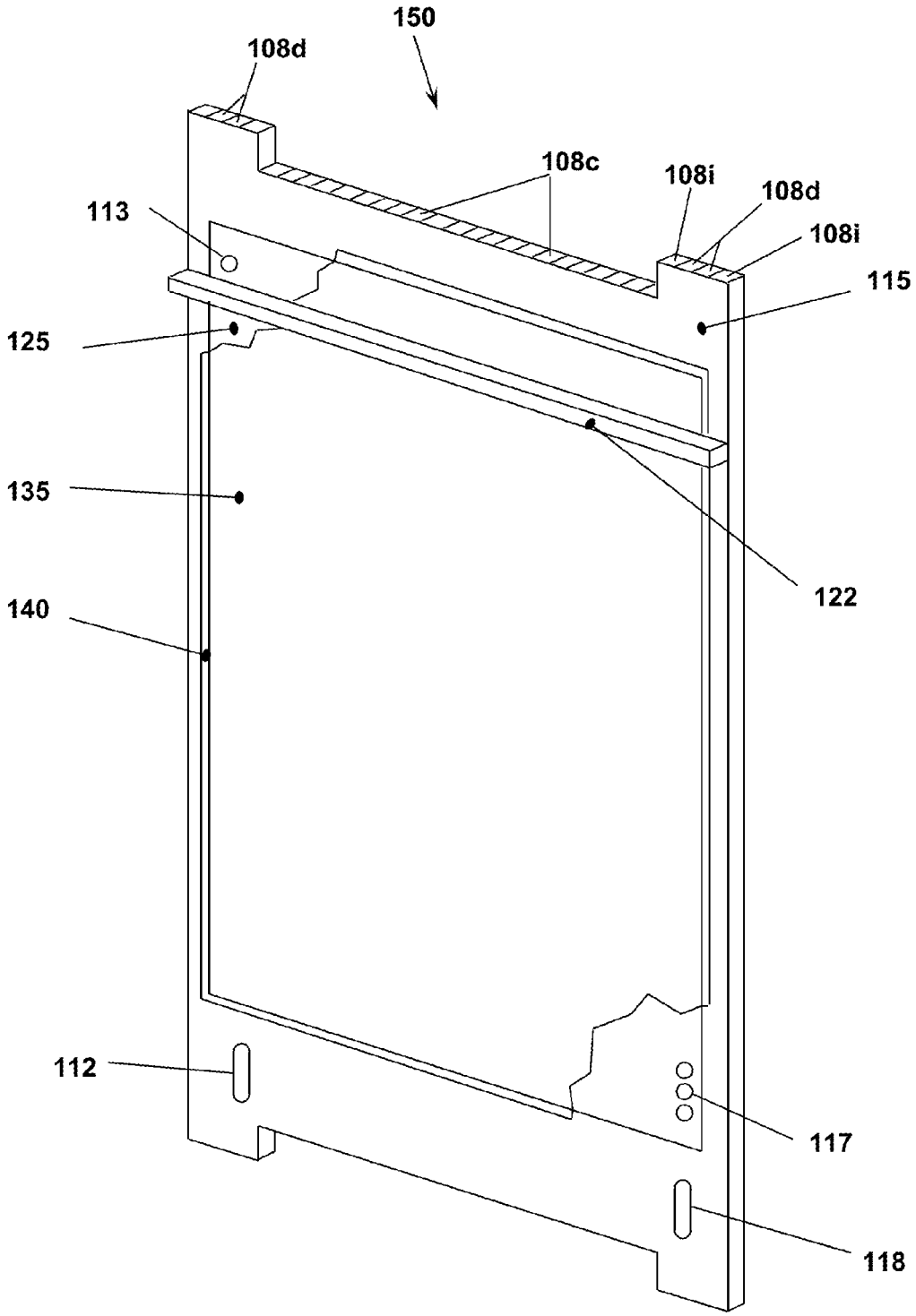
FIG. 2A is a perspective view of a plate used in a heat and mass exchanger according to an exemplary embodiment of the present invention.

FIG. 2A shows one plate assembly 150 according to an exemplary embodiment of the present invention of a multi-plate liquid-desiccant HMX that is evaporatively cooled by a mixture of air and water. The plate assembly 150 may be composed of (1) a vertical extruded plate 115, (2) desiccant-wetted wicks 125 on the front and back walls of the plate, and (3) a thin membrane 135 covering the entire surface of each wetted wick 125. (Only the wick and membrane on the front wall appears in FIG. 2A and the membrane is cut away at two corners to show underlying features.) The membrane 135 may be bonded to the extruded plate 115 around the periphery of the membrane along bond line 140. The methods of bonding include adhesive bonding and thermal welding (which is particularly advantageous when the extruded plate and the membrane are made from the same thermoplastic polymer).

FIG. 2A shows the wicks 125 creating a uniform film of desiccant behind the membrane. The uniform film of desiccant improves the performance of a liquid-desiccant HMX. However, it should be appreciated that other techniques may be used to create a uniform film of desiccant behind the membrane. One alternative is spot welding the membrane 135 directly to the extruded plate at multiple points in a pattern that forces a flow of desiccant between the membrane and the extruded plate to spread.

Also, in other exemplary embodiments, as will be described in more detail, the membrane 135 may be excluded.

In an exemplary embodiment of the present invention, the plate 115 is a twin-wall polypropylene extruded plate with a 4 mm overall thickness, although it should be appreciated that other polymers and plate thicknesses could be used to make the extrusion. Furthermore, if the desiccant is not corrosive or if a polymer is not appropriate for the application, the extrusion may be a malleable metal such as aluminum or copper. The wicks 125 that are applied to the front and back may be made from 10-mil thick films of polystyrene that have been flocked with polyester fibers that are approximately 20 mils long, although it should be appreciated that other wicks could be used, such as, for example, (a) woven natural fibers such as cotton cheese cloth, (b) woven synthetic fibers such as polyester and nylon, (c) knitted fabrics of both natural and synthetic fibers, (d) films of non-woven fibers where the fibers are a synthetic polymer, glass, cellulose, or natural fiber, and (e) flock directly adhered to the surface of the plate. Preferably, the wick is sufficiently thick to allow the desiccant to flow within the wick and be readily wetted by the liquid desiccant. The wick is also preferably in good thermal contact with the plate 115 so that heat readily flows between the two. The membrane 135 may be a thin, microporous, hydrophobic, polypropylene film. A suitable film may be one sold by Celgard, of Charlotte, N.C., USA, as EZ-2090. Other microporous films and membranes may also be appropriate, such as those manufactured by dPoint Technologies, of Vancouver, BC, Canada, Dupont, of Wilmington, Del., USA, and W.L. Gore, of Newark, Del., USA.

Exemplary embodiments of the invention described herein address the way that the liquid desiccant is supplied to and removed from wicks 125 that are covered by a membrane 135. In particular, the vertical channels of the extruded plate 115 may be separated into those that are used for cooling, i.e., cooling channels 108*c*, and those that are used for the supply and removal of liquid desiccant to and from the wicks, i.e., desiccant channels 108*d*. Inactive channels 108*i* may optionally be provided both between the desiccant channels and the cooling channels and at the outer edges of the extruded plate 115. As shown in FIG. 2A, in order not to penetrate either the membrane 135 or the bond line 140 between the membrane and the plate 115, desiccant is supplied to the wick through the desiccant channels 108*d* within the plate. The desiccant flows into these channels through the supply opening 112 in the face of the plate, which is located outside of the area enclosed by the bond line 140, and leaves the desiccant channels through the supply orifice 113, which is located within the area enclosed by the bond line 140 and which is located high on the face of the plate. Thus, the desiccant is supplied to the wick without penetrating either the membrane or the bond line. This approach to supplying the desiccant to the wick without penetrating either the membrane or the bond line greatly simplifies the manufacturing of a multi-plate liquid-desiccant HMX by, for example, eliminating the need to seal a penetration in a membrane that might be only 10 microns thick.

Similar to the supply of desiccant, the desiccant is removed from the wick by allowing it to flow through the removal orifices 117, which are located within the area enclosed by the bond line 140 and which are located low on the face of the plate, into a desiccant channel 108*d* and then out of the desiccant channel through the removal opening 118, which is located outside of the area enclosed by the bond line 140. The desiccant channels 108*d* are sealed at the top and bottom edges of the extruded plate 115 to prevent desiccant from leaving the plate at these locations. Open ends of desiccant channels may be sealed by, for example, filling the openings with a sealant, such as Dow Corning® 734 Flowable Sealant, produced by Dow Corning Corporation, of Midland, Mich., USA, or thermally welding the channels closed. It may simplify the fabrication of the plate assembly 150 if the inactive channels 108*i* are also sealed at their ends. (Both the desiccant channels 108*d* and the inactive channels 108*i* are shown open at their ends in FIG. 2A so that their internal structure is revealed.) It may also simplify the fabrication if the channels that are to be sealed (i.e., channels 108*d* and 108*i*) are slightly longer than the channels that are not sealed (i.e., channels 108*c*).

In the embodiment of the invention shown in FIG. 2A, the desiccant channels 108*d* that supply the liquid desiccant to the wicks 125 are located on the left side of the extruded plate 115 and the desiccant channels 108*d* that remove the liquid desiccant from the wicks are located on the right side. It is possible to use the same desiccant channels for the supply and removal of the liquid desiccant by, for example, (1) locating the supply opening 112 at a location above the supply orifice 113, and (2) sealing the desiccant channels at a location between the supply orifice 113 and the removal orifices 117 so that desiccant cannot flow within the channels between these two orifices.

It is also possible to locate the desiccant channels 108*d* away from the sides of the extruded plate 115, in which case the supply orifice and/or removal orifice would also be located away from the sides of the extruded plate. In this configuration, cooling channels 108*c* would be located on both sides of a set of desiccant channels 108*d*.

In all practical implementations, the extruded plate 115 of the liquid-desiccant HMX will have many more cooling channels 108*c* than desiccant channels 108*d*. Since it is important that the wicks 125 be uniformly wetted by desiccant, a means may be provided for insuring that the liquid desiccant that leaves the supply orifice 113 spreads laterally across the entire width of the wick 125. One means that has been used to insure that the liquid desiccant spreads across the entire width of the wick is to insert a narrow spreader bar 122 located immediately below the supply orifice 113 that presses lightly against the outer surface of the membrane 135. (In a liquid-desiccant HMX that has multiple plate assemblies 150, the spreader bars 122 would be lightly squeezed between neighboring plate assemblies.) The spreader bar 122 will encourage the liquid desiccant that leaves the supply orifice to first flow horizontally before flowing vertically down in the wick 125. Preferably, the spreader bar 122 does not press too firmly against the membrane or too much pressure will be needed to force the liquid desiccant past it. One approach to insuring that the spreader 122 bar does not press too firmly against the membrane is to make it from a compressible foam.

A second means used to insure that the liquid desiccant spreads across the entire width of the wick includes securely bonding the membrane to the wick at several locations near the top edge of the wick (but below the location of the supply orifice 113). These bonds between the membrane and the wick may be made so that the wick is no longer porous in the immediate vicinity of the bond. These bonds will create a resistance to the downward flow of desiccant in the wick similar to the resistance caused by the spreader bar 122, thereby encouraging the desiccant that leaves the supply orifice 113 to flow horizontally.

Figure 2B:
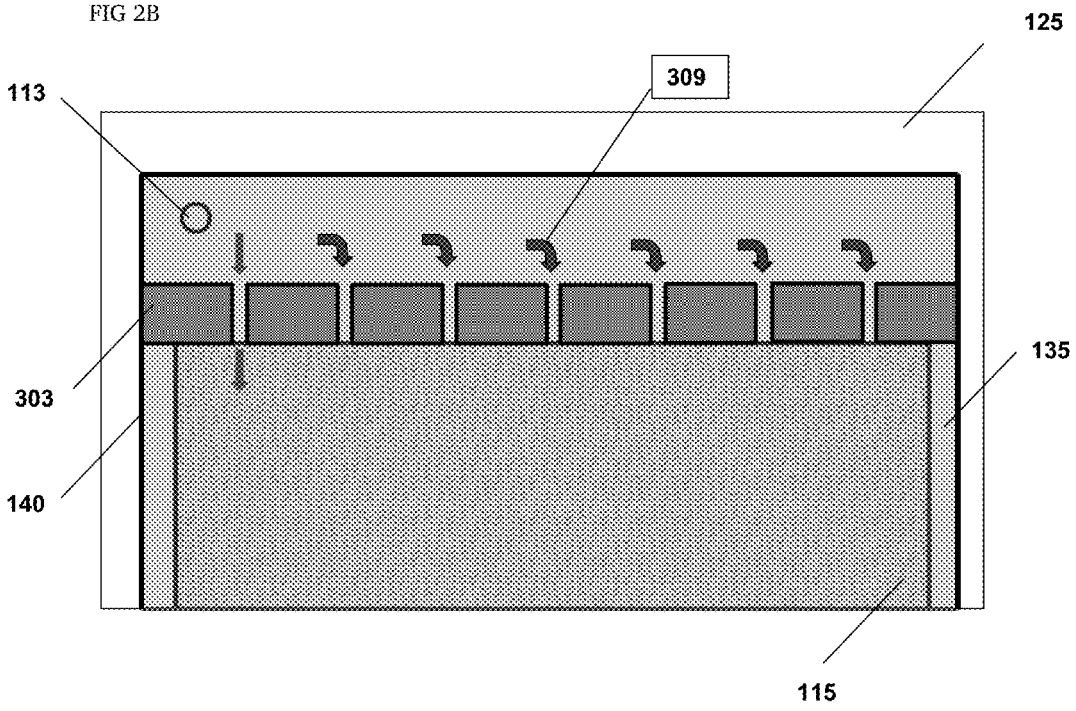
FIG. 2B is a plan view of a top section of a plate used in a heat and mass exchanger according to an exemplary embodiment of the present invention.

This second means to achieving the desired spreading can be simplified by limiting the vertical extent of the wick 125 to the region of plate 115 that is below the locations where the membrane is locally bonded to create a resistance to the downward flow of desiccant. This approach is shown in FIG. 2B, where the regions in which the membrane 135 is locally bonded are shown as feature 303. In this approach the membrane 135 is bonded directly to the plate 115 and not to the wick. The flow arrows 309 show the direction of desiccant flow horizontally across the top of the plate 115 and then vertically downward past the bonded regions 303.

Figure 2C:
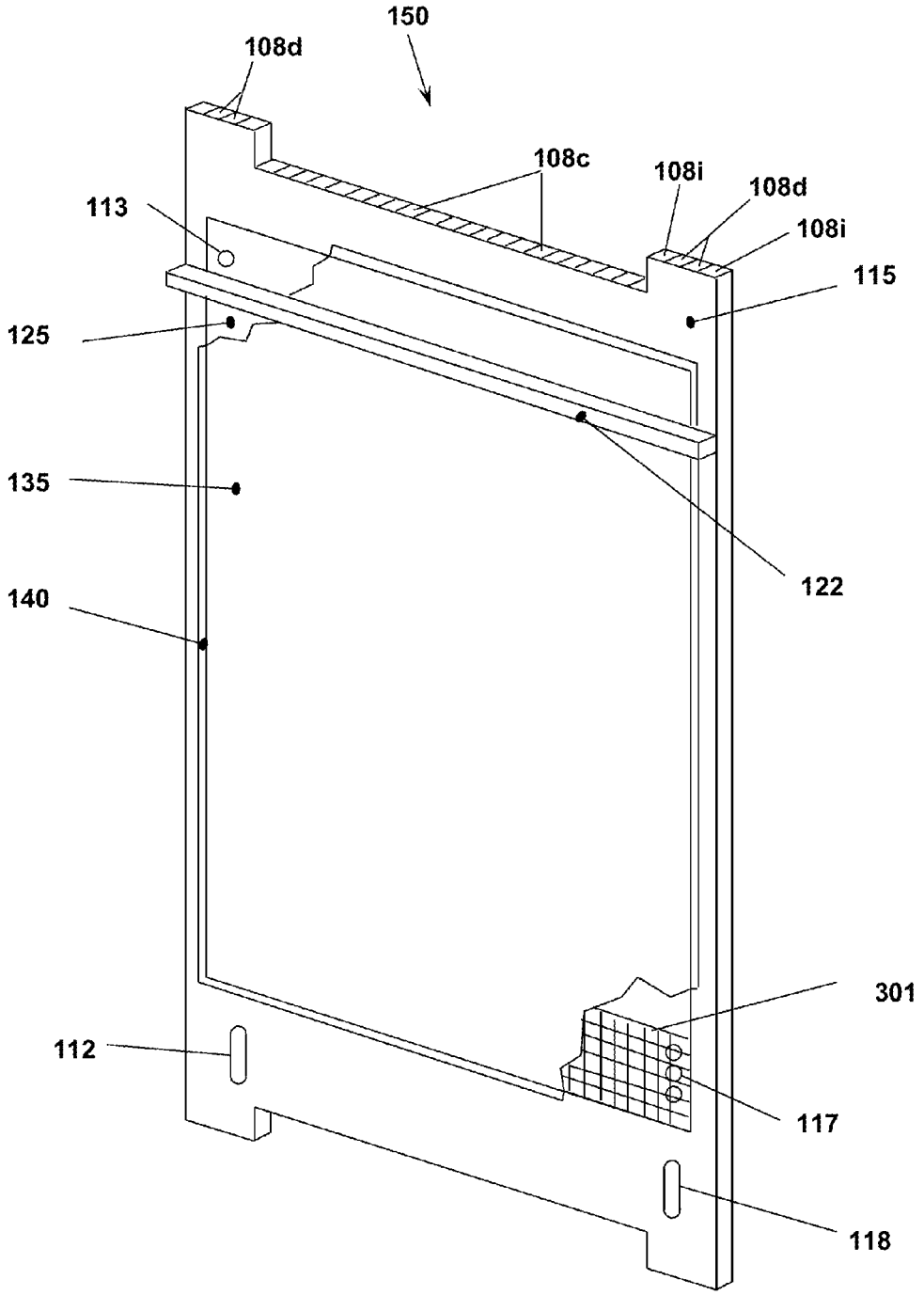
FIG. 2C is a perspective view of a plate used in a heat and mass exchanger according to an exemplary embodiment of the present invention.
Figure 2D:
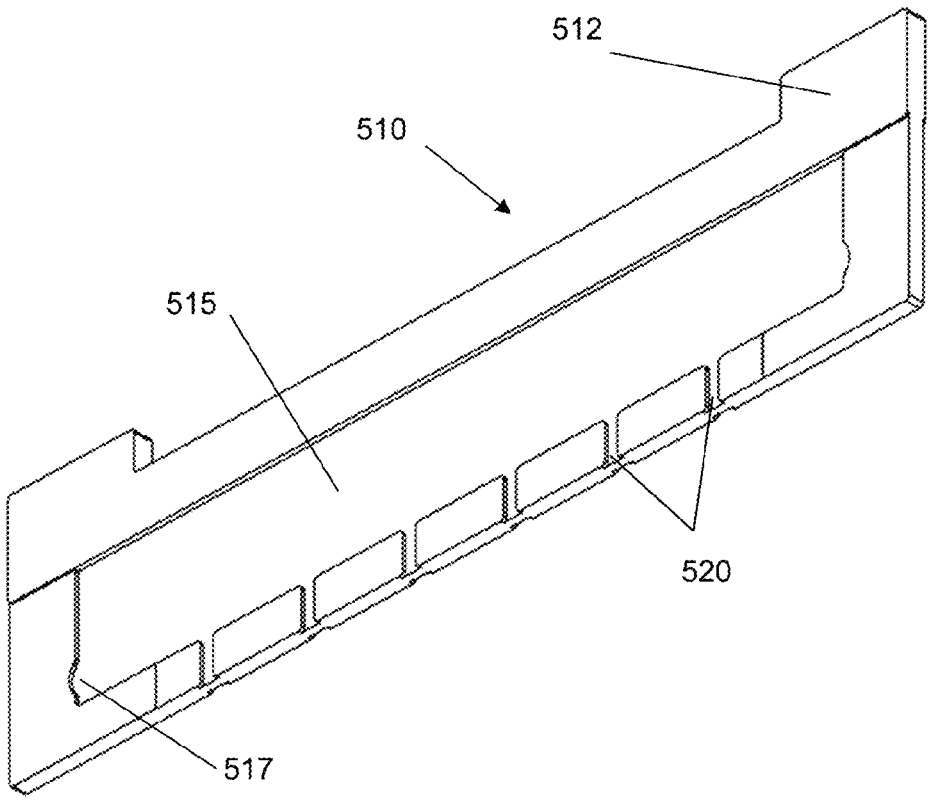
FIG. 2D is a perspective view of a spreader insert used in a heat and mass exchanger according to an exemplary embodiment of the present invention.

As shown in FIG. 2D, a molded spreader insert 510 can also be used to insure that the liquid desiccant spreads across the entire width of the wick. For a multi-plate liquid-desiccant HMX, the spreader insert 510 may be positioned at the top of the plate 115 and compressed between two plates. The spreader insert may have a pattern of recesses on both its faces consisting of a nearly rectangular pocket 515, and multiple delivery grooves 520. The spreader insert 510 is positioned so that the supply orifice 113 in the plate is under the pocket 515. This insures that a non-recessed section of the spreader insert does not press against the supply orifice and block the flow of desiccant out of the supply orifice. As shown in FIG. 2D, the pocket 515 may have an extended cutout 517 in the vicinity of the supply orifice to insure that spreader insert does not tightly press the membrane against the supply the orifice.

As later discussed in reference to FIG. 3A, the molded spreader insert 510 may perform the function of sealing the gap between neighboring plates 115 along their top edges. To perform this function, the molded spreader insert may have an upper sealing section 512 whose thickness equals the gap between neighboring plates (as measured from the bare surface of the plates).

In many applications, each plate 115 has a desiccant-wetted wick on each of its two faces. In these applications each plate may have a supply orifice 113 on each face. If the supply orifices 113 on each face are in fluid communication with the same desiccant channel 108*d*, the flow rate of desiccant supplied to each face of the plate may differ by more than 20%. This difference in flow rate, which can be caused by differences in the size and geometry of the two supply orifices 113, differences in the tension in the membrane that covers the orifices, and other possible effects, will degrade the performance of the liquid-desiccant HMX.

The flow rate of desiccant through the two supply orifices can be made almost equal by laterally offsetting the position of one supply orifice relative to the second so that each orifice is in fluid communication with a different desiccant channel 108*d*. By designing the system so that the viscous fluid pressure drop of the desiccant as it flows upward in the desiccant channel 108*d* is large compared to the pressure drop across the supply orifice 113, the desiccant flows in the two desiccant channels will be equalized (assuming that the two desiccant channels have nearly identical geometries). In some applications, the high viscosity of the desiccant combined with the small cross section of the desiccant channel 108*d* may provide the required viscous fluid pressure drop. However, if this is not the case, the two desiccant channels may be modified so that the viscous fluid pressure drop is increased. One possible modification is to use an extruded plate that has desiccant channels 108*d* of smaller diameter than the cooling channels 108*c*. Another possible modification is to insert smaller diameter tubes into each of the two desiccant channels 108*d*. The two tubes may have identical geometries and be potted in place so that the desiccant is forced to flow within the tube and not around it.

The liquid desiccant drains by gravity from the wicks 125 through the removal orifices 117. It is desirable to use multiple removal orifices (or a single large removal orifice) so that the desiccant freely drains through the orifice and a back pressure of liquid desiccant is not created (which would make the thin, flexible membrane bulge). As an example of this approach to decreasing the back pressure behind the membrane, three removal orifices 117 are shown on each face of each plate in FIG. 2A.

The pressure in the liquid desiccant at the removal orifice 117 may be less than that of the air flowing over the membrane. Under these conditions, the membrane can seal against the removal orifice, thus acting as a "flapper" valve that shuts off the flow of desiccant through the removal orifice.

Several approaches to preventing the membrane from sealing against the removal orifice may be implemented. All approaches maintain a gap between the membrane and the removal orifice that allows desiccant to freely flow through the removal orifice. In one approach, which is shown in FIG. 2C, a woven screen-like insert 301 is located under the membrane 135. The thickness of the screen-like material is less than half the width of the air gap between neighboring plates (so that the screen-like material is not crushed when plates are assembled into a multi-plate stack). The screen-like insert 301 may extend the full width of the wick 125, and be positioned at the bottom of the wick directly above the lower bond line 140 that seals the membrane 135 to the plate 115. The height of the screen may be such that it covers the removal orifices 117, extending only slightly past the removal orifices so that it only minimally interferes with mass exchange between the desiccant and the air flowing across the membrane.

Figure 2E:
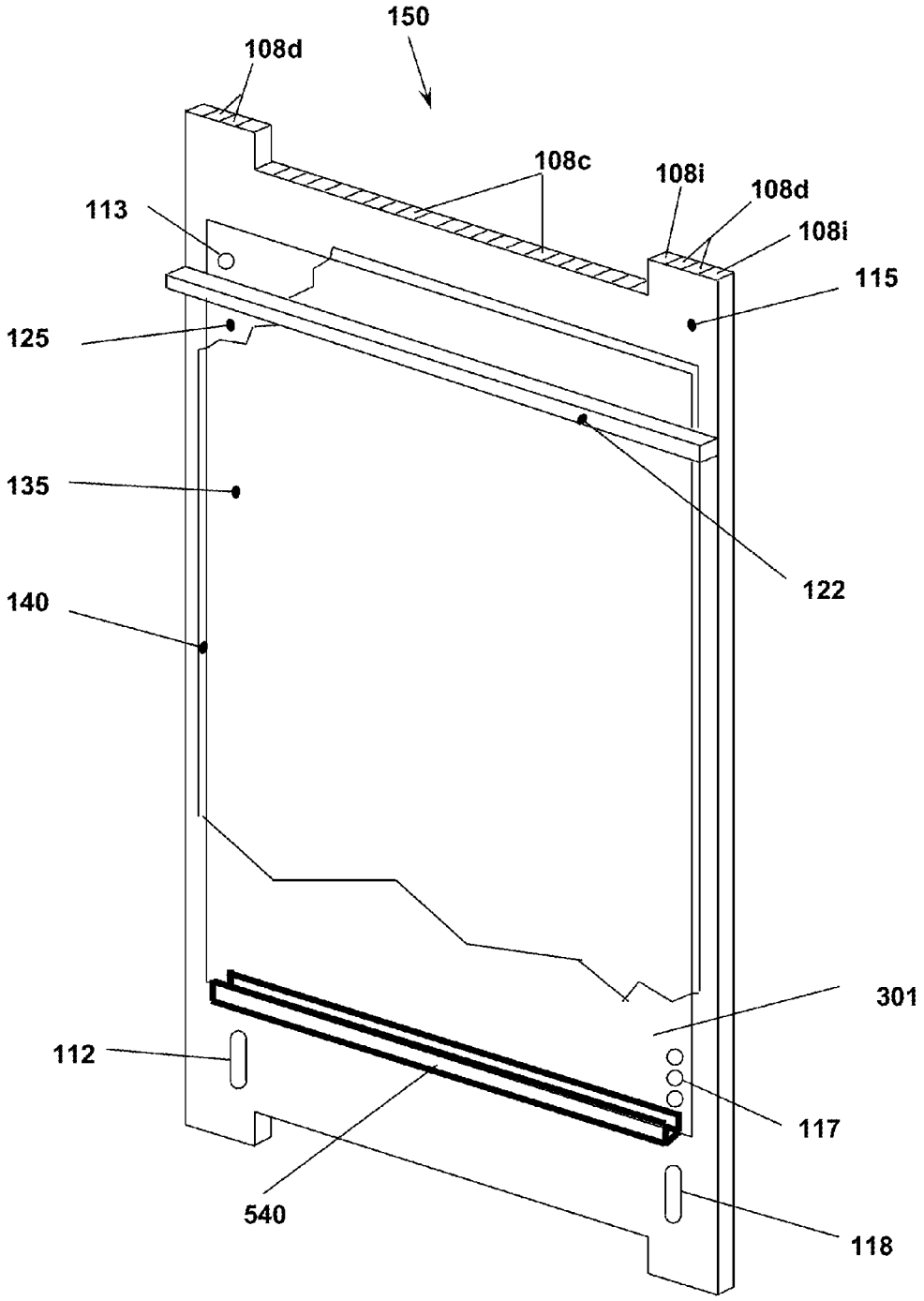
FIG. 2E is a perspective view of a plate used in a heat and mass exchanger according to an exemplary embodiment of the present invention.

A second approach to preventing the membrane from sealing the removal orifice includes insertion of a narrow rigid spacer between the membrane and the wick, referred to as a membrane spacer 540, that prevents the membrane from being drawn by suction up against the wick or the removal orifice. A membrane spacer 540 with a U-profile that has been successfully used is shown in FIG. 2E. As shown in this figure the membrane spacer extends almost the entire width of the area covered by the membrane and it is located vertically below the removal orifices 117.

In many applications the flow of air between plate assemblies 150 is laminar. As is well known, heat and mass transfer coefficients in laminar flow are low. The rates at which heat and mass are exchanged between the liquid desiccant and the air that flows on the other side of the membrane can be increased by forcing the laminar flow to mix. In this regard, as shown in FIG. 3B, a mixing spacer element 206 can be used both to maintain a uniform gap between neighboring plates and to mix the laminar flow. The mixing spacer element 206 may be made from a twin-wall extruded plate. As shown in FIG. 3B, sections of the front wall 102 and back wall 104 are removed from the twin-wall extruded plate to expose the webs 106. The section of the extruded plate where the front wall and back wall is not removed may form a spine to which the exposed webs are all attached and which also acts as a spacer when it is positioned between two plate assemblies. The exposed webs are mechanically deformed so that they are twisted around an axis that is aligned with the internal channels 108 of the spacer to produce the helical vanes 109. Each helical vane 109 imparts a small vortical flow to the air as it flows through and past the mixing spacer element. The vortical flow that is imparted to the air mixes the laminar flow. The vortical flow will persist for a longer length if neighboring helical vanes 109 are configure so that they impart vortical flow with opposite spins (i.e., a vortical flow with a clockwise rotation has neighboring vortical flows with counterclockwise rotations).

Figure 3A:
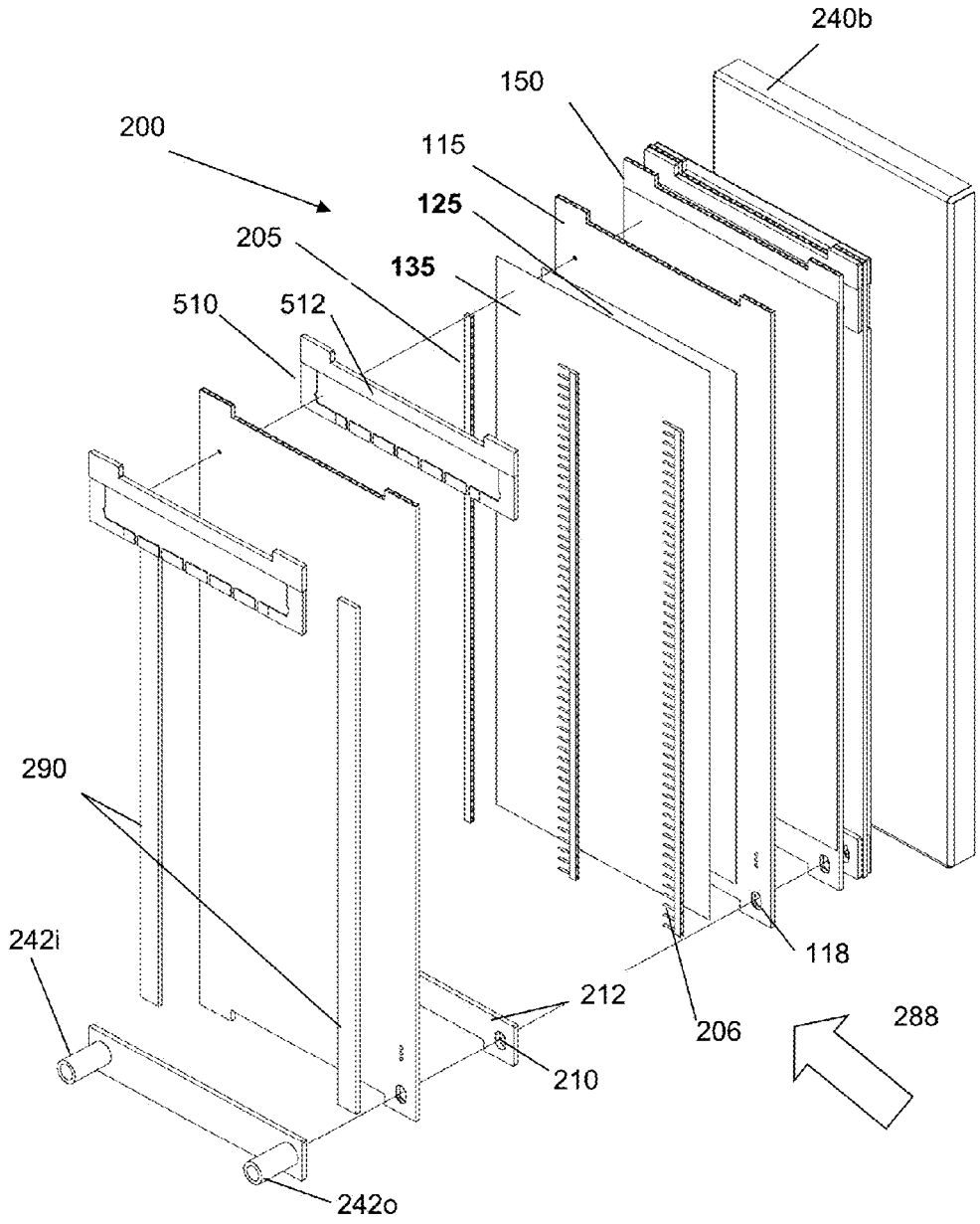
FIG. 3A is an exploded perspective view of a heat and mass exchanger according to an exemplary embodiment of the present invention.
Figure 3B:
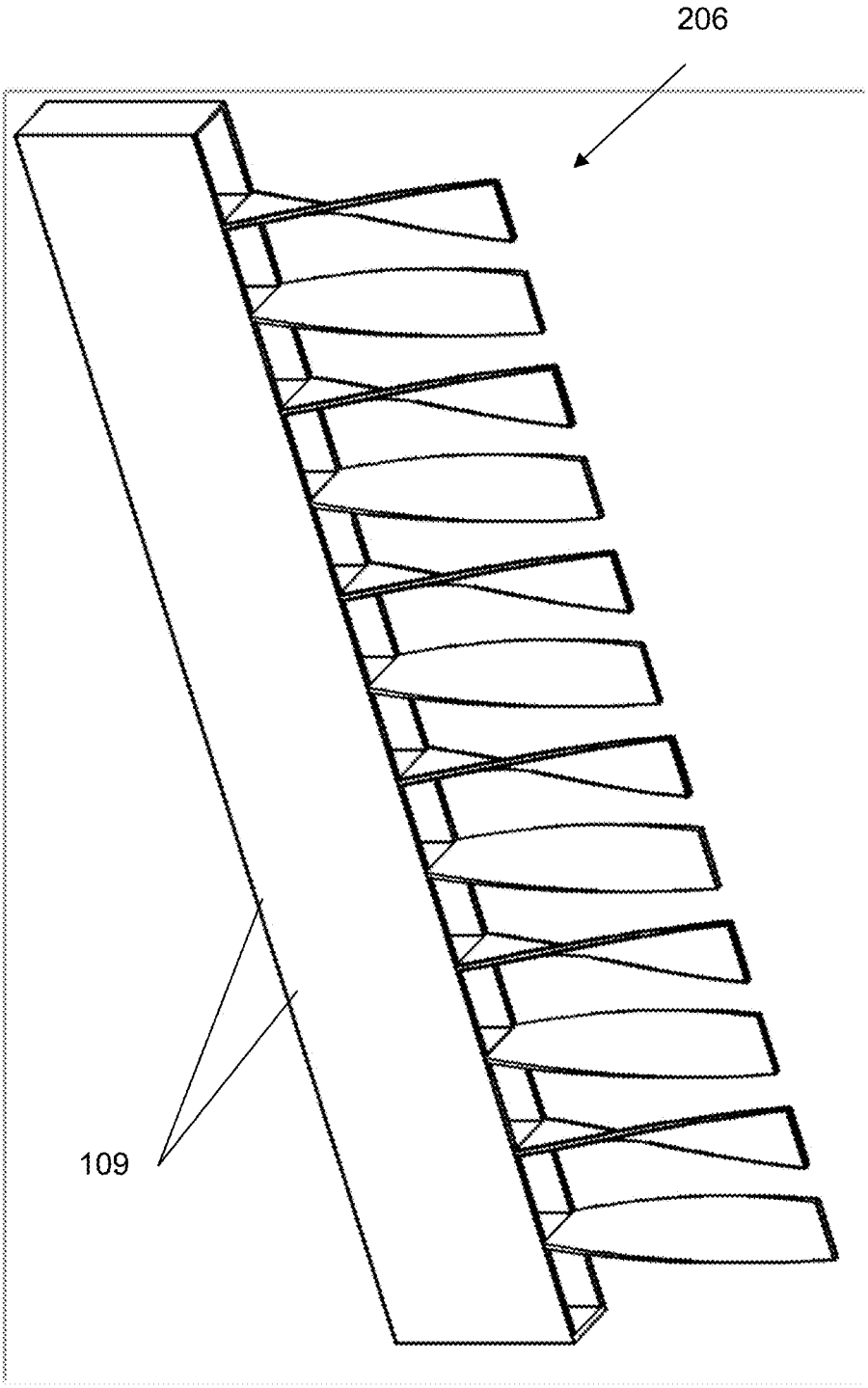
FIG. 3B is a perspective view of a spacer used in a heat and mass exchanger according to an exemplary embodiment of the present invention.

FIG. 3A shows a multi-plate liquid-desiccant HMX 200 according to an exemplary embodiment of the present invention that is evaporatively cooled by a mixture of water and air. The HMX 200 is partially exploded so that internal features are revealed. The multi-plate liquid-desiccant heat and mass exchanger 200 includes hollow plain spacer elements 205 and hollow mixing spacer elements 206 that maintain the air gap between plate assemblies 150 while letting air flow horizontally through them, lower face seals 210, and upper molded spreader inserts 510. The lower face seals 210 have desiccant feed openings 212 that align with the supply opening 112 (not shown in FIG. 3A) and the removal opening 118 that are in the extruded plate 115. Each lower face seal 210, which has a thickness equal to the size of the air gap between plate assemblies 150, is bonded to or compressed between the two adjacent plate assemblies to form leak-tight manifolds for the supply and removal of liquid desiccant from the HMX 200 and to prevent the water and air that flow through cooling channels 108*c* from entering the gaps between the plate assemblies 150. Each upper molded spreader insert 510 has an upper sealing section 512, which also has a thickness equal to the size of the air gap between plate assemblies. This upper sealing section 512 is bonded to or compressed between the two adjacent plates to form a leak-tight seal that prevents the water and air that flow through the cooling channels 108*c* from entering the gaps between the plate assemblies 150.

For the liquid-desiccant HMX shown in FIG. 3A, the air that is to be dried and cooled flows horizontally from right to left in the gaps between the plates. The non-mixing spacer element 205 is positioned at the left edge of each gap (where the air exits from the HMX 200). These plain spacer elements 205 may be made from a twin-wall extruded plate, similar to that shown in FIG. 1, that has a thickness equal to the width of the air gap between plate assemblies. The twin-wall extruded plate is cut perpendicular to the internal channels 108 into narrow strips that have a width preferably greater than the width of the air gap so that they cannot accidently rotate around their long axis. When installed between plate assemblies, the internal channels 108 within the spacer elements 205 are aligned with the direction of the air flow.

The mixing spacer elements 206 may be positioned at the right edge and middle of the gap between the plates. These mixing spacer elements 206 both maintain the gap between the plates and mix the laminar air flow.

The number of non-mixing spacer elements 205 and mixing spacer elements 106 that are positioned in each air gap may depend on the width and flatness of the plates and the requirement to mix the laminar flow.

Figure 8:
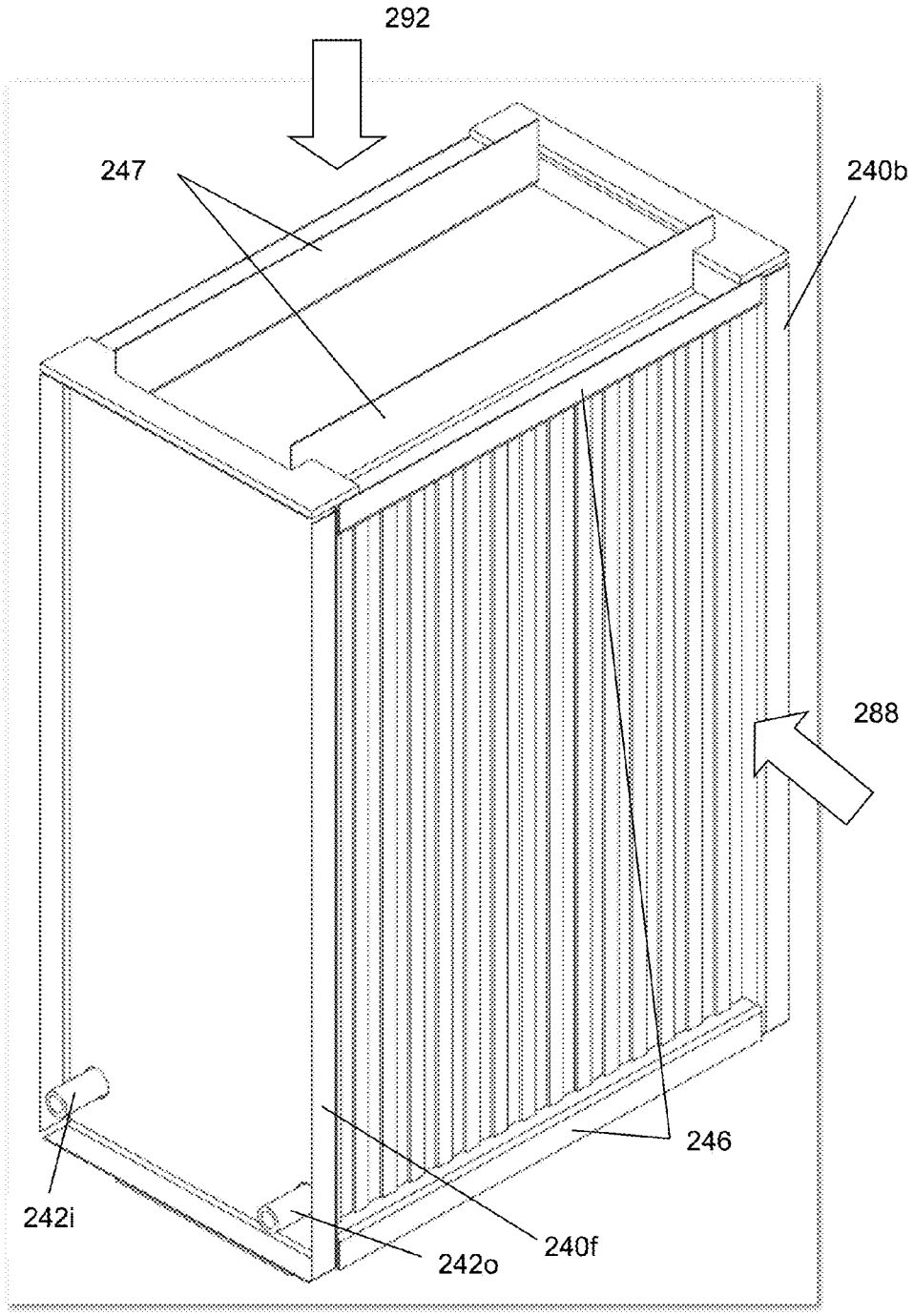
FIG. 8 is a perspective view of heat and mass exchanger according to an exemplary embodiment of the present invention.

In a practical implementation of the multi-plate liquid-desiccant HMX 200, the stack of plate assemblies 150 are lightly compressed between a front end plate which is referred to by reference number 240*f* in FIG. 8 and back end plate 240*b*. A liquid-desiccant inlet pipe 242*i* and liquid-desiccant outlet pipe 242*o* are sealed to the front face of the leftmost plate 115 and also compressed between the front end plate and back end plate. Liquid desiccant is fed to and collected from the multi-plate liquid-desiccant HMX 200 through these pipes.

The leftmost plate may be modified so that the supply orifice on its front face is sealed, thus preventing desiccant from flowing on the front face of the leftmost plate. With the supply orifice sealed, the gap between the front end plate 240*f* and the leftmost plate assembly 150 cannot exchange mass with the air 288, and air blockage strips 290 are inserted in this gap to prevent the flow of air.

As shown in FIG. 8, in addition to the front end plate 240*f* and back end plate 240*b*, a complete assembly for a multi-plate liquid-desiccant HMX that could be installed in a building may have process mounting flanges 246 to which the process air ducts, through which the air to be cooled and dried would flow, may attach and cooling mounting flanges 247 to which the cooling air ducts, through which the air and/or water 292 that cools the liquid-desiccant HMX may flow, may attach.

Exemplary embodiments of the present invention have been described in the context of an evaporatively cooled liquid-desiccant HMX (i.e., a mixture of air and water flows within the cooling channels 108*c*, typically making a single pass through the extruded plate). It should be appreciated that with appropriate modifications, the liquid-desiccant HMX may be liquid-cooled with water or other fluid flowing through the cooling channels.

Figure 4:
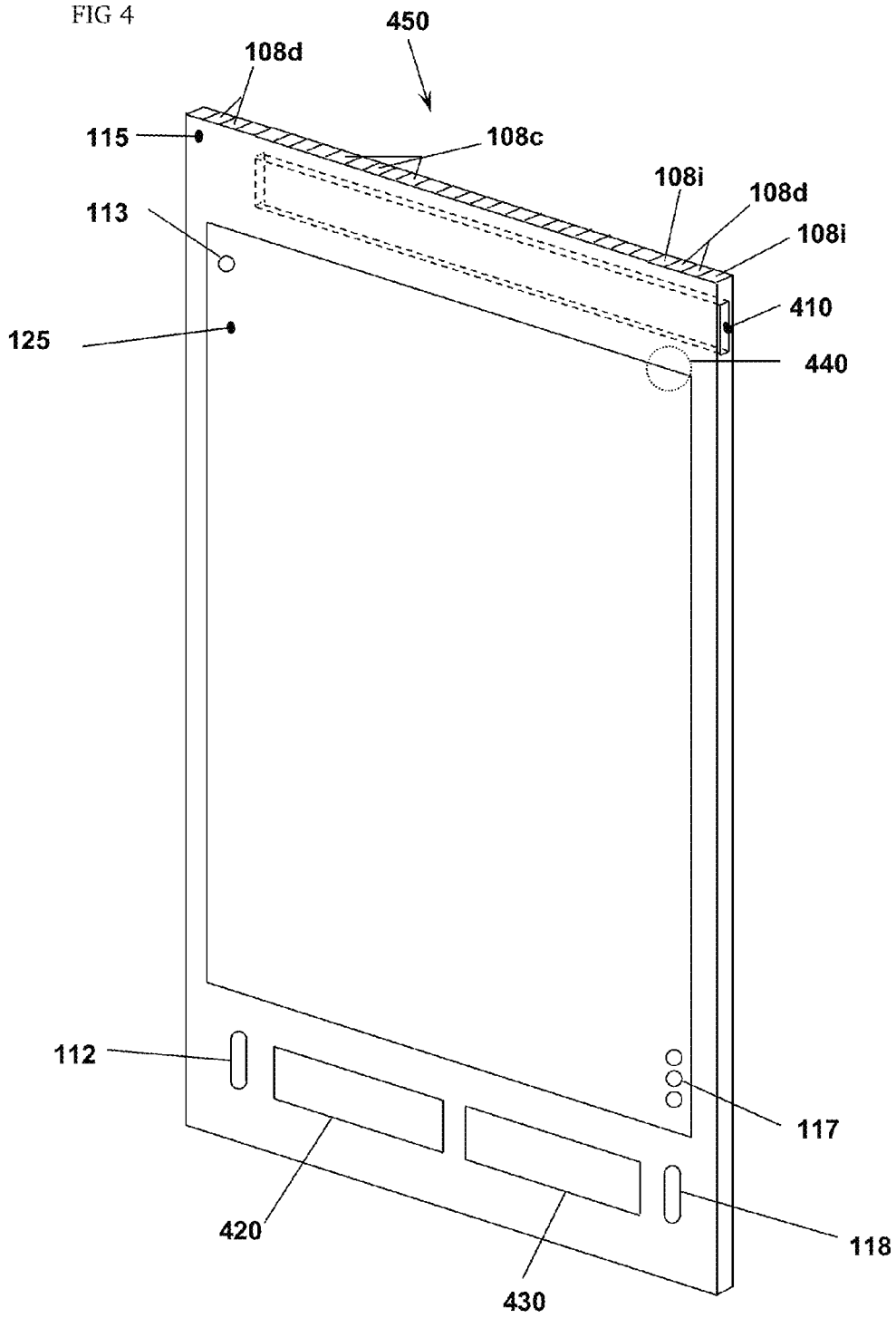
FIG. 4 is a perspective view of a plate used in a heat and mass exchanger according to an exemplary embodiment of the present invention.

FIG. 4 shows a single plate assembly 450 for a liquid-cooled liquid-desiccant HMX according to another exemplary embodiment of the present invention. As shown in this figure, a coolant enters the cooling channels 108*c* within the extruded plate 115 through a coolant inlet opening 420 that penetrates both the front and back walls of the extruded plate; and coolant leaves the cooling channels 108*c* through a coolant outlet opening 430 also that penetrates the front and back walls of the extruded plate. The coolant that flows upward through the cooling channels that intercept the coolant inlet opening 420 flows across the top of the extruded plate through a borehole 410, which passes through the webs between cooling channels, and then downward through the cooling channels that intercept the coolant outlet opening. (The use of boreholes to turn a coolant flow 180 degrees within the plane of an extruded plate is described in U.S. Pat. No. 7,269,966, the contents of which are incorporated herein by reference in their entirety.) Although not shown in FIG. 4, both the coolant channels 108*c* and desiccant channels 108*d* in the extruded plate may be sealed at their ends so that liquid cannot leave the extruded plate at these locations. Also, the borehole 410 may be sealed at its end where it penetrates the edge of the extruded plate. Also, the desiccant channels 108*d* that intercept the borehole 410 may be sealed in the region denoted 440 so that desiccant cannot flow into the borehole.

Two or more plate assemblies 450 that are liquid-cooled can be stacked in an arrangement similar to that shown in FIG. 3A for plate assemblies 150 that are evaporatively cooled to create a multi-plate liquid-cooled HMX. This liquid cooled HMX may use spacer elements 205 and lower face seals 210 appropriately modified to allow the liquid coolant to enter and leave the plate assemblies 450.

Exemplary embodiment of the present invention in which the channels 108 of a single extruded plate 115 are segregated into two or more groups, with each group transporting a different liquid, gas or liquid/gas mixture, and in particular, where at least one liquid flows both through the channels and on the external face of the plate, can be applied to systems other than a liquid-desiccant HMX with membrane-covered wicking surfaces. In particular, exemplary embodiments of the present invention may include multiple extruded plates 115 with wicks 125 on the external surfaces of the plates but without membranes covering the wicks. In this application, a feature may be added to force the liquid desiccant that exits from the supply orifice 113 into and across the wick. As shown in FIG. 5, this feature may be a distribution plate 310 with grooves 315 on its face. The distribution plate 310 may cover the supply orifice 113 of an extruded plate 115 and extend horizontally across the top of the wick 125. The distribution plate 310 may be narrow compared to the height of the wick so that it covers only a small fraction of the wick. The grooves 315 on the face of the distribution plate 310 may direct desiccant from the supply orifice to several discharge points 320 across the top of the wick. Similar to desiccant distributor shown in FIG. 2B for a plate assembly that uses both a wick and a membrane, it may be advantageous to limit the height of the wick so that the distribution plate 310 presses directly against the extruded plate 115 and the liquid desiccant enters the wick only after passing through the grooves 315.

The function of grooves on the face of the distribution plate to direct the liquid desiccant from the supply orifice to several discharge points may be duplicated by other configurations of recesses on the face of the distribution plate.

Figure 6:
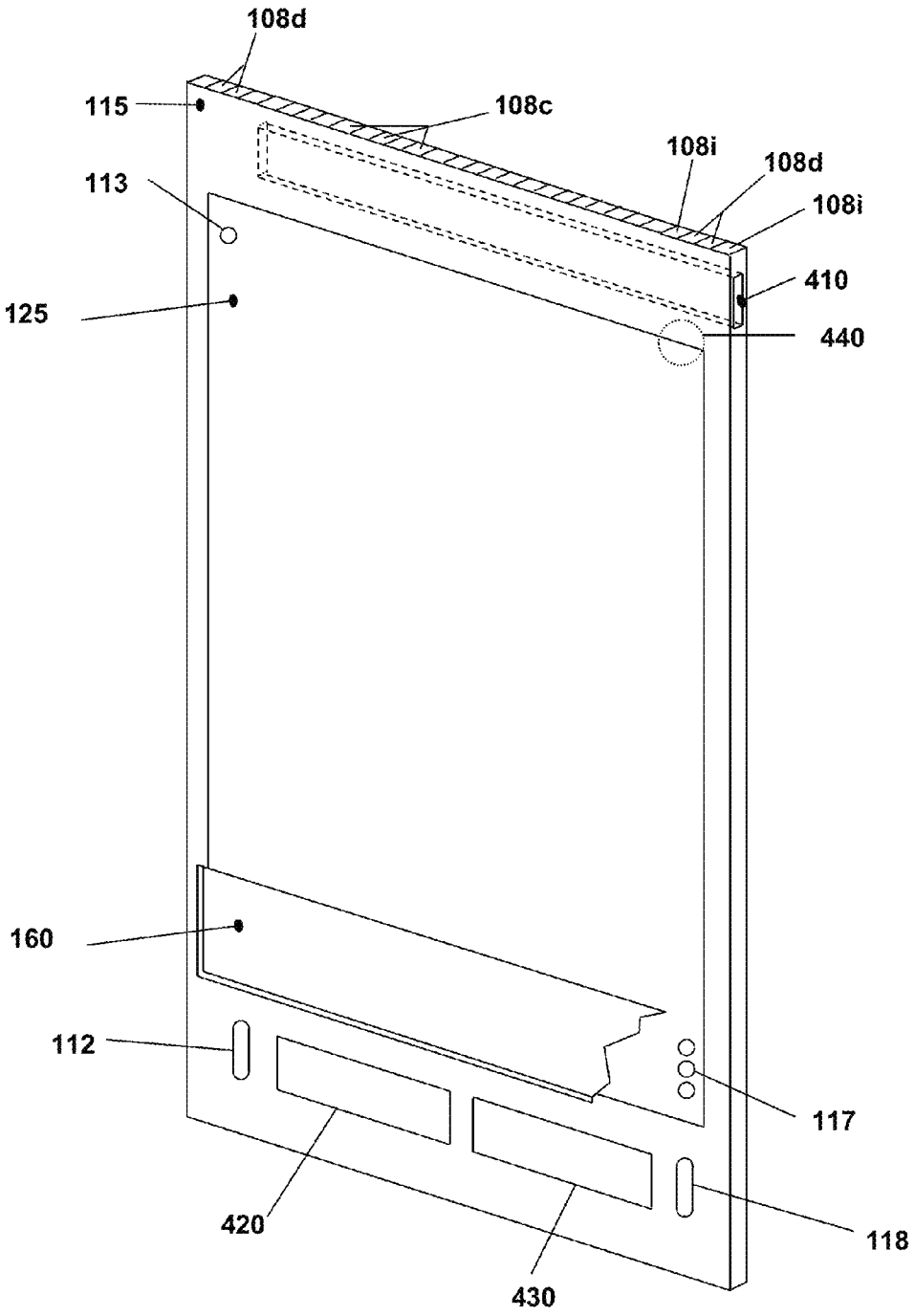
FIG. 6 is a perspective view of a plate used in a heat and mass exchanger according to an exemplary embodiment of the present invention.

For a liquid-desiccant HMX without membrane-covered wicks, the desiccant that drains off the wick may be allowed to flow directly into a collection sump located below the HMX. Alternately, as shown in FIG. 6, a removal orifice 117 in the face of the extruded plate 115 located near the bottom of the wick 125 may be used to direct the desiccant into a desiccant channel 108*d* within the extruded plate. An film 160, sheet or cover plate may be placed over the bottom portion of the wick extending to a height above the location of the removal orifice 117. The film 160, sheet, or cover plate may be sealed to the extruded plate 115 on three sides (i.e., the bottom, left and right sides). The liquid desiccant that flows down in the wick 125 may flow behind this film 160, sheet, or cover plate and leave this space through the removal orifice 117. The woven screen-like insert that prevents the membrane in FIG. 2C from sealing against the removal orifices 117 may also be used to prevent the film 160, sheet or cover plate from sealing against the removal orifices in FIG. 6. The woven screen-like insert may also create a thin gap between the upper edge of the film 160, sheet or cover plate and the underlying wick 125 to insure that the liquid desiccant does not flow out of the wick onto the film, sheet or cover plate. It should be appreciated that other means may be used to create a thin gap between the upper edge of the film, sheet or cover plate and the underlying wick. In particular, a film or sheet may be thermoformed to have a pattern of ridges or protuberances that provide the required gap. Also, a pattern of grooves or recesses may be machined or molded into the face of a cover plate to provide the required gap.

As a liquid-desiccant HMX, exemplary embodiments of the invention are conveniently applied with air flowing horizontally between spaced apart vertical plates 115. In this application, it is convenient to implement the invention with the internal channels 108*c* and 108*d* vertically oriented so that the lower face seals 210 and upper face seals 205 do not interfere with the flow of air. However, there may be applications, including but not limited to those in which a gas flows vertically between the spaced apart vertical plates, where the internal channels 108*c* and 108*d* are horizontally oriented.

Figure 7:
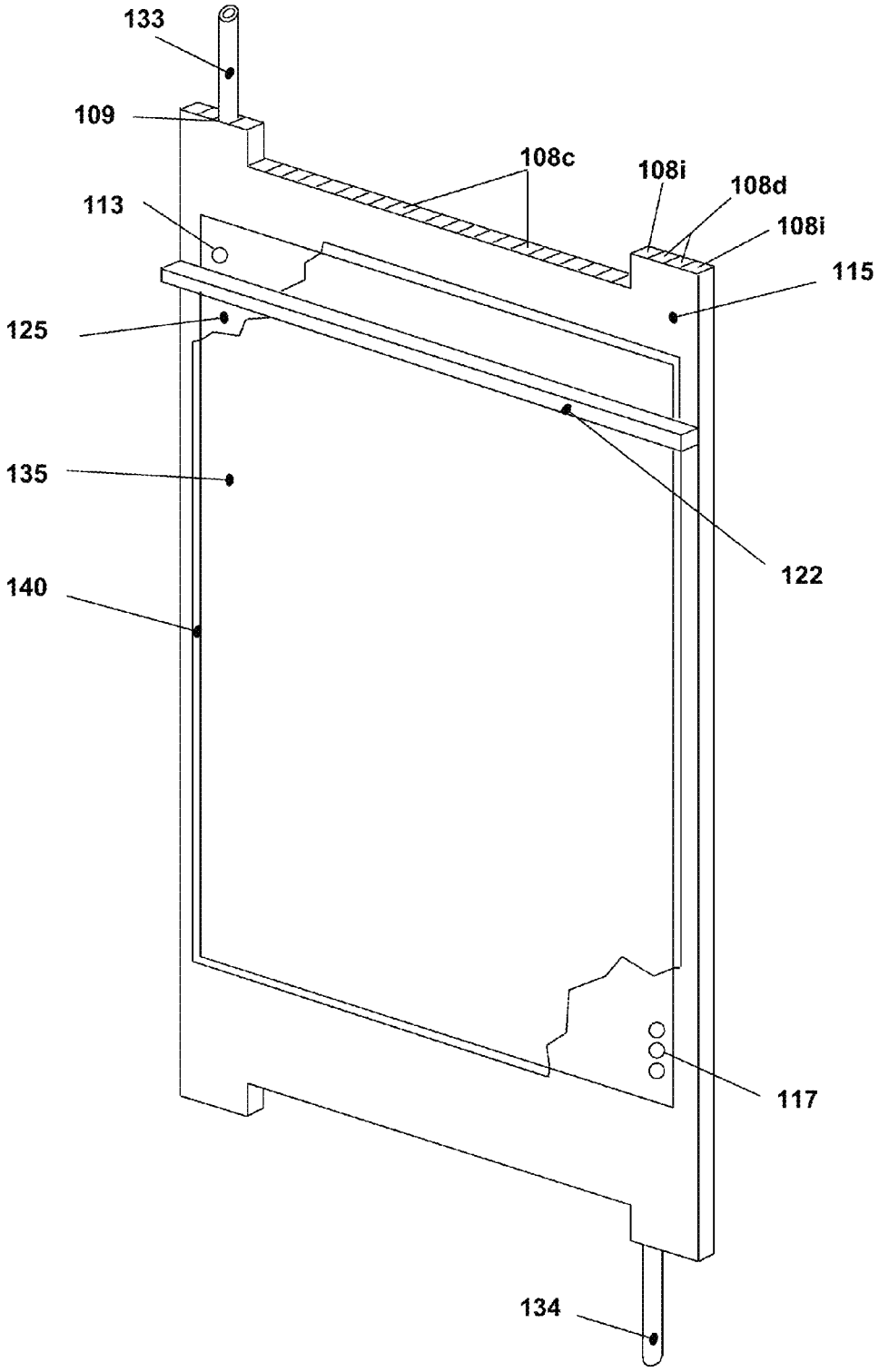
FIG. 7 is a perspective view of a plate used in a heat and mass exchanger according to an exemplary embodiment of the present invention.

In some applications, particularly where the multi-plate HMX is disassembled into individual plates, it may be desirable not to bond lower face seals 210 to the faces of the plate assemblies 150, as is preferably done when the supply openings 112 and removal openings 118 for the desiccant are on the faces of the plate assemblies. As shown in FIG. 7, the lower face seals 210 may be eliminated in an embodiment of the invention that supplies and removes liquid desiccant to and from the desiccant channels 108*d* through the channel openings 109 at the edges of the extruded plates 115. In this configuration, the openings 109 may not be sealed closed. Instead, supply tubes 133 and collection tubes 134 may be inserted into one or more desiccant channels in each extruded plate and the supply/collection tubes 133, 134 may be sealed in place. Desiccant may be either supplied to or removed from the desiccant channels through these supply/collection tubes. The supply tubes 133 may be connected to a common supply manifold and the collection tubes 134 may be connected to a common collection manifold.

Exemplary embodiments of the invention may be applied in situations that do not involve liquid desiccants. In particular, distillation processes such as membrane distillation have the need to remove a liquid (i.e., the product condensate) from the space between a membrane and a plate that is being cooled by the feed brine. Exemplary embodiments of the invention described herein may be configured so that the feed brine flows in the central channels of an extruded plate and the product condensate flowing on the outside of the extruded plate is removed from between the membrane and the plate through removal orifices in the face of the plate that intercept outer channels within the plate that are isolated from the channels through which the feed brine flows.

Other distillation processes that condense liquid on an extruded plate but do not use a membrane may similarly use exemplary embodiments of the invention to collect the condensed liquid from the plate (similar to the preceding description for the collection of liquid desiccant from a liquid-desiccant HMX that does not use membranes).

Furthermore, exemplary embodiments of the invention have been applied in situations where the extruded plate is cooled by either a liquid, gas or liquid/gas mixture. It should be appreciated that exemplary embodiments of the invention may be applied where the extruded plate is heated by either a liquid, gas or liquid/gas mixture. Such an application may be a liquid-desiccant HMX that is used to regenerate the desiccant.

In industry, there are many processes in which a vapor is exchanged between a liquid that flows on contact surfaces and a gas that flows between the contact surfaces, and in which the absorption or desorption of the vapor by the liquid is either endothermic or exothermic. Exemplary embodiments of the invention described herein provides a convenient means to either internally heat or cool the contact surface using an internally flowing heat transfer fluid while supplying a second liquid to the outside of the contact surface for the purpose of either absorbing a vapor from the gas or desorbing a vapor to the gas. An example of this type of process would be the absorption of carbon dioxide from air or flue gas that flows over an internally cooled contact surface that is wetted by an amine or other liquid that absorbs carbon dioxide.

Exemplary embodiments of the invention can also be applied to an evaporatively cooled fluid cooler that is implemented as multiple plates. In this application, water or another fluid to be cooled flows within a first set of channels [for example, channel 108*c* in FIG. 4] and the evaporating water is supplied to and collected from the outside of the plates via a second set of channels [for example, channel 108*d*]. An evaporatively cooled fluid cooler would be an example of the invention in which the same type of fluid flows through both sets of channels (for example, both channels 108*c* and 108*d* in FIG. 4), although the two flows may be kept separated.

Various aspects of the invention can also be applied to a thermal desalination system that uses a membrane or hydrophobic microporous film (which for simplicity may also be referred to as a "membrane") to isolate seawater or other impure water from the potable water that is being produced. This thermal desalination system, which is commonly referred to as "membrane distillation", may be implemented with plates that have the feed seawater flowing within them, a membrane covering their outer surfaces, and heated seawater flowing on the side of the membrane that is away from the plate either in direct contact with the membrane or with a narrow gap of non-condensible gas separating the heated seawater from the membrane. In this type of desalination system there is a continuous flow of water molecules across the membrane from the warmer seawater to the outer surface of the plate which is cooled by the feed seawater flowing within it. Similar to the implementation of the liquid desiccant HMX, the plates for the thermal desalination system may have multiple internal channels divided into a first set that is used to collect the potable water that is generated between the membrane and the plate and a second set through which the feed seawater flows. However, unlike the liquid desiccant HMX, a gas does not flow in the gaps between plates and a liquid is not supplied to the space between the membrane and the plate.

Various exemplary embodiments of the invention have been explained in applications that use thin, flat, twin-wall extruded plates, typically, but not necessarily made from plastic. Twin-wall extruded plates are now commonly available with very thin walls. However, it should be appreciated that exemplary embodiments of the invention may be applied to a thin, flat plate with internal, parallel channels manufactured by a means other than extrusion. As an example, common corrugated cardboard is a flat plate with internal, parallel channels. Although corrugated cardboard made from paper sheets may be difficult to implement, a similarly configured plate made from two flat sheets that are bonded to a central corrugated sheet, where the sheets are either plastic or metal, may be used instead of twin-wall extruded plates. Also, exemplary embodiments of the invention may be readily implemented with thin plates that are curved.

In all embodiments in which the plate 115 of the HMX is made from plastic, the effectiveness of the HMX can be improved if the plastic plate is made from a polymer that has a high thermal conductivity, i.e. a thermal conductivity greater than 1.0 W/m-C. Polymers with high thermal conductivity are available from Cool Polymers, Inc. of North Kingstown, R.I.

Exemplary embodiments of the invention have been described in applications where a first liquid (typically a desiccant) is delivered to the outside of a plate from a first set of channels within the plate, a first gas flows in the gap between neighboring plates, and a second liquid, a second gas, or a liquid/gas mixture flows in a second set of channels within the plate. Two aspects of the invention can be applied more broadly. In particular, many applications where a first gas or first liquid flows between parallel surfaces and the first gas or first liquid exchanges mass and/or thermal energy with the surfaces or with a second gas or second liquid flowing on the other sides of the surfaces the exchange of mass and/or thermal energy could be made more efficient by using the mixing spacers shown in FIG. 3B.

Figure 9:
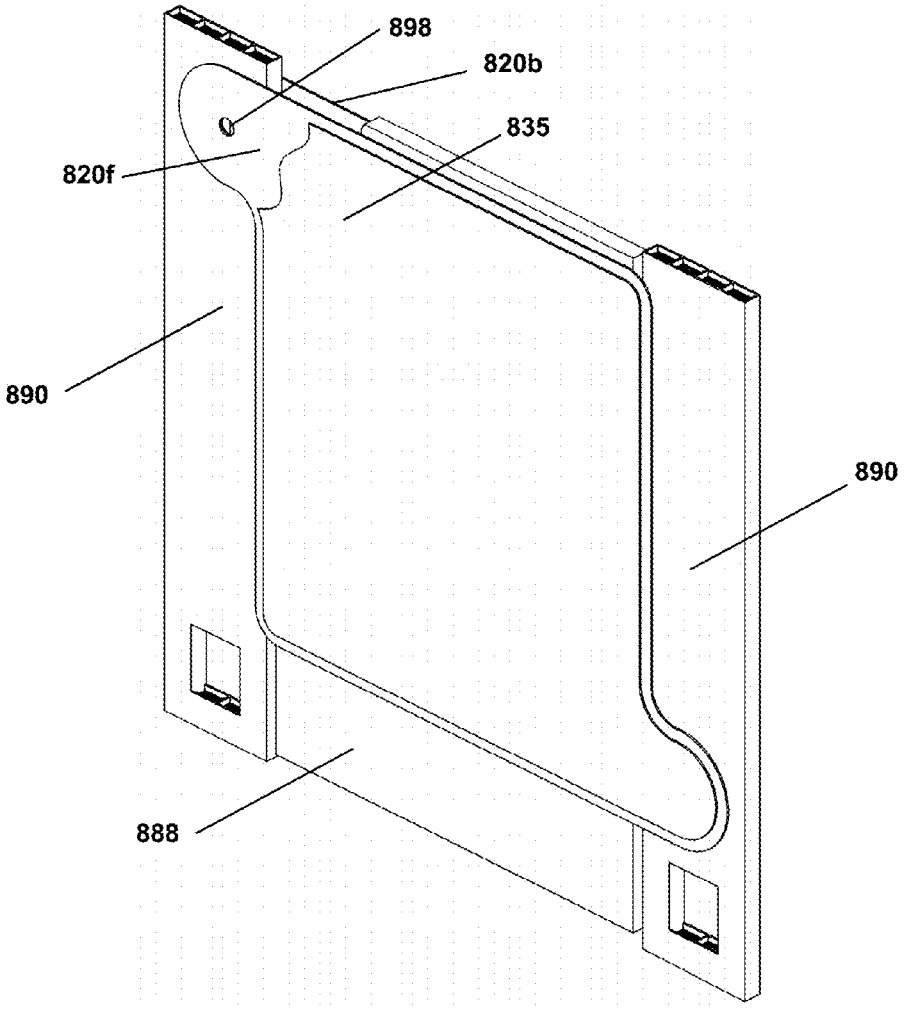
FIG. 9 is a perspective view of a heat and mass exchanger according to an exemplary embodiment of the present invention.

Also, there are applications where a liquid must be delivered in equal amounts to both faces of a plate or to separate surfaces that are attached to each face of the plate, and the plate has internal, parallel channels. These applications may benefit from the use of two different internal channels for the delivery of liquid to each face in a way that a viscous flow pressure drop within the channel equalizes the two flows. FIG. 9 shows an exemplary embodiment where a liquid is delivered in equal amounts to separate surfaces, which are impermeable films (820*f* and 820*b*) that are attached to front and back faces of the plates 890 and the impermeable films have a membrane 835 covering them and bonded to them at the periphery of the membrane. Liquid can enter and/or exit the space between the impermeable film and the membrane only through openings 898 in the impermeable film (only one of which is exposed in FIG. 9), the openings 898 being aligned with supply orifices and removal orifices in the plates 890. This embodiment is important because the liquid that is supplied to the impermeable film is contained within a confined space defined by the impermeable film and the membrane that is bonded to the impermeable film. In this configuration, the liquid within the space between the impermeable film and the membrane may be cooled or heated by the surface of a heat exchanger 888 that is in contact with the impermeable film but that is not an integral part of the plate or plates 890 that supply and/or collect the liquid to the impermeable film. The assembly composed of the impermeable film and overlaying membrane may employ one of the means previously described to spread the liquid over the surface of the impermeable film. Also, the assembly composed of the impermeable film and overlaying membrane can be applied to heat and mass exchangers that use common internal channels within a plate to deliver liquid to each face of the plate, or which deliver liquid to only one face of the plate. It should be appreciated that the impermeable film could have a wick on the side that is wetted by a liquid to help spread the liquid and the membrane could be replaced by a microporous hydrophobic film. Finally, it should be appreciated that embodiments of the invention that use a membrane or microporous hydrophobic film, such as the one shown in FIG. 2A, could bond the membrane or microporous hydrophobic film to an impermeable film with openings 898 that align with supply orifices 113 and/or removal orifices 117 in the plate 115 when the impermeable film is bonded to the plate 115 (as opposed to bonding the membrane to the plate 115).

Now that embodiments of the present invention have been shown and described in detail, various modifications and improvements thereon will become readily apparent to those skilled in the art. Accordingly, the spirit and scope of the present invention is to be construed broadly not limited by the foregoing specification.

What is claimed is:

1. A heat and mass exchanger that exchanges heat and/or mass between a first gas stream and a first liquid stream while simultaneously heating or cooling the first liquid stream, the heat and mass exchanger comprising:

a plurality of vertical plates that are spaced apart from one another by gaps so as to allow a first gas to flow between the plates, each plate comprising:

a front wall that defines a front surface of the plate;

a back wall that defines a back surface of the plate; and parallel channels disposed between the front and back walls, each parallel channel being separated from a neighboring channel over at least a portion of the total length of the channel by a web, the parallel channels comprising:

a first set of parallel channels, a first liquid flowing within the first set of channels and over one of the front or back surfaces of the plate, the first liquid having a bulk composition comprising one or more constituents, the first gas having at least one constituent in common with the first liquid; and a second set of parallel channels, a first fluid flowing within the second set of channels.

2. The heat and mass exchanger of claim 1, wherein the channels are oriented vertically.

3. The heat and mass exchanger of claim 1, wherein the channels are oriented horizontally.

4. The heat and mass exchanger of claim 1, wherein at least one of the plurality of plates further comprises:

one or more supply orifices disposed in one of the front or back walls of the plate, the one or more supply orifices supplying the first liquid to the one of the front or back surfaces of the plate from the first set of channels.

5. The heat and mass exchanger of claim 4, wherein the at least one of the plurality of plates comprises a first supply orifice disposed in the front wall of the plate and a second supply orifice disposed in the back wall of the plate, the first supply orifice being in communication with channels from the first set of parallel channels that are different from channels from the first set of parallel channels that are in communication with the second supply orifice.

6. The heat and mass exchanger of claim 4, wherein the at least one of the plurality of plates comprises:

one or more removal orifices disposed in one of the front or back walls of the plate, the first liquid flowing from the one of the front or back surfaces of the plate to the first set of channels through the one or more removal orifices.

7. The heat and mass exchanger of claim 6, wherein channels in the first set of channels that supply the first liquid to the one or more supply orifices are different from channels in the first set of channels that receive the first liquid from the one or more removal orifices.

8. The heat and mass exchanger of claim 6, wherein at least one channel in the first set of channels that supply the first liquid to the one or more supply orifices also receives the first liquid from the one or more removal orifices, and the at least one channel is modified so that the first liquid cannot flow within the at least one channel between the one or more supply orifices and the one or more removal orifices.

9. The heat and mass exchanger of claim 6, wherein the at least one plate further comprises a membrane that separates the first liquid that flows over the one of the front or back surfaces of the plate from the first gas that flows in the gaps between the spaced apart plates, the membrane preventing portions of the bulk composition of the first liquid from entering the flow of first gas while allowing one or more constituents of the first liquid and first gas to be exchanged.

10. The heat and mass exchanger of claim 9, wherein a periphery of the membrane is sealed to the at least one plate so that the one or more supply orifices and the one or more removal orifices are covered by the membrane.

11. The heat and mass exchanger of claim 6, wherein at least one of the plurality of plates comprises a wick within which the first liquid flows over the one of the front or back surfaces of the plate.

12. The heat and mass exchanger of claim 11, wherein the at least one plate further comprises a membrane that separates the first liquid that flows over the one of the front or back surfaces of the plate from the first gas that flows in the gaps between the spaced apart plates, the membrane preventing portions of the bulk composition of the first liquid from entering the flow of first gas while allowing one or more constituents of the first liquid and first gas to be exchanged.

13. The heat and mass exchanger of claim 12, wherein a periphery of the membrane is sealed to the at least one plate so that the one or more supply orifices and the one or more removal orifices are covered by the membrane.

14. The heat and mass exchanger of claim 4, wherein at least one of the plurality of plates further comprises a means for spreading the first liquid over the one of the front or back surfaces of the plate.

15. The heat and mass exchanger of claim 14, wherein the means for spreading comprises a thin film that is intermittently bonded to the plate across the one of the front or back surfaces of the plate.

16. The heat and mass exchanger of claim 14, wherein the means for spreading comprises a spreader insert having a pattern of recesses that directs the first liquid from the one or more supply orifices to a plurality of discrete locations across the one of the front or back surfaces of the plate.

17. The heat and mass exchanger of claim 6, further comprising a covering disposed over the one or more removal orifices, the covering comprising means for directing the first liquid towards the one or more removal orifices.

18. The heat and mass exchanger of claim 17, wherein the means for directing comprises at least one of a wick, an insert or a woven screen.

19. The heat and mass exchanger of claim 17, wherein the means for directing comprises protuberances or recesses formed in the covering.

20. The heat and mass exchanger of claim 17, wherein the at least one plate comprises a wick within which the first liquid flows over the one of the front or back surfaces of the plate, at least a portion of the wick being disposed between the covering and the one of the front or back surfaces of the plate.

21. The heat and mass exchanger of claim 6, wherein the at least one of the plurality of plates further comprises:

a supply opening formed in one of the front or back walls through which the first liquid is supplied to the first set of channels for delivery to the supply orifice; and a removal opening formed in one of the front or back walls through which the first liquid is removed from the first set of channels after entry of the first liquid through the removal orifice.

22. The heat and mass exchanger of claim 6, wherein the at least one of the plurality of plates further comprises:

a supply opening formed in a first edge of the plate through which the first liquid is supplied to the first set of channels for delivery to the supply orifice; and a removal opening formed in a second edge of the plate through which the first liquid is removed from the first set of channels after entry of the first liquid through the removal orifice.

23. The heat and mass exchanger of claim 22, wherein the first and second edges are the same edge.

24. The heat and mass exchanger of claim 1, further comprising a spacer disposed between at least two of the plurality of parallel plates, the spacer maintaining the gap between the at least two parallel plates and mixing the first gas flowing between the at least two parallel plates.

25. The heat and mass exchanger of claim 24, wherein the spacer comprises:

a spine that maintains the gap between the at least two parallel plates, the spine being porous so that the first gas can flow past the spine; and vanes disposed on the spine that create vortices in a flow of the first gas.

26. The heat and mass exchanger of claim 24, wherein the spacer is made from a twin-wall extruded plate with multiple internal webs that define channels within the extruded plate by removing sections of the front and back wall of the extrusion and deforming exposed webs so that each is twisted about an axis that is aligned with the channels.

27. A membrane desalination unit for thermally distilling potable water from impure water, comprising:

a plurality of vertical plates that are spaced apart from one another by gaps so as to allow impure water to flow between the plates, each plate comprising:

a front wall that defines a front surface of the plate;

a back wall that defines a back surface of the plate;

a membrane disposed over one of the back or front surfaces of the plate, the membrane allowing water vapor to cross but not liquid water; and parallel channels disposed between the front and back walls, each parallel channel being separated from a neighboring channel over at least a portion of the total length of the channel by a web, the parallel channels comprising:

a first set of parallel channels, impure water flowing within the first set of channels; and a second set of parallel channels, potable water flowing between the one of the back or front surfaces of the plate and the membrane and collected within the second set of parallel channels.

28. A method for exchanging heat and/or mass between a first gas stream and a first liquid stream while simultaneously heating or cooling the first liquid stream, comprising the steps of:

providing a plurality of vertical plates that are spaced apart from one another by gaps, each plate comprising:

a front wall that defines a front surface of the plate;

a back wall that defines a back surface of the plate; and parallel channels disposed between the front and back walls, each parallel channel being separated from a neighboring channel over at least a portion of the total length of the channel by a web, the parallel channels comprising:

a first set of parallel channels; and a second set of parallel channels;

flowing a first gas within the gaps between the plurality of plates;

flowing a first liquid within the first set of channels and over one of the front or back surfaces of the plate, the first liquid having a bulk composition comprising one or more constituents, the first gas having at least one constituent in common with the first liquid; and flowing a first fluid within the second set of channels.

29. The method of claim 28, wherein the first liquid is a desiccant.

30. The method of claim 28, wherein the first fluid is a coolant.

31. The method of claim 28, wherein both the first fluid and the first liquid are water.

32. A vertical plate for use with a heat and mass exchanger that exchanges heat and/or mass between a first gas stream and a first liquid stream while simultaneously heating or cooling the first liquid stream, the vertical plate comprising:

a front wall that defines a front surface of the plate, a first supply orifice disposed in the front wall of the plate;

a back wall that defines a back surface of the plate, a second supply orifice disposed in the back wall of the plate; and parallel channels disposed between the front and back walls, each parallel channel being separated from a neighboring channel over at least a portion of the total length of the channel by a web, the parallel channels comprising:

a first set of parallel channels, a first liquid flowing within the first set of channels and through the first and second supply orifices so that the first liquid flows over the front and back surfaces of the plate, the first liquid having a bulk composition comprising one or more constituents, the first gas having at least one constituent in common with the first liquid; and a second set of parallel channels, a first fluid flowing within the second set of channels.

33. A spacer disposed between at least two parallel surfaces, at least one of the parallel surfaces exchanging heat and/or mass with a first fluid stream that flows between the at least two parallel surfaces, the spacer comprising:

a spine that maintains a gap between the at least two parallel surfaces, the spine being porous so that the first fluid can flow past the spine; and vanes disposed on the spine and between the at least two parallel plates that create vortices in a flow of the first fluid so as to mix the first fluid, wherein the spacer is made from a twin-wall extruded plate with multiple internal webs that define channels within the extruded plate by removing sections of the front and back wall of the extrusion and deforming exposed webs so that each is twisted about an axis that is aligned with the channels so as to form the vanes.

34. A heat and mass exchanger that exchanges heat and/or mass between a first gas stream and a first liquid stream while simultaneously heating or cooling the first liquid stream, the first liquid having a bulk composition comprising one or more constituents, the first gas having at least one constituent in common with the first liquid, the heat and mass exchanger comprising:

a plurality of vertical plates that are spaced apart from one another by gaps, each plate comprising:

a front wall that defines a front surface of the plate;

a back wall that defines a back surface of the plate; and parallel channels disposed between the front and back walls, each parallel channel being separated from a neighboring channel over at least a portion of the total length of the channel by a web, a first liquid flowing within one or more of the channels;

an impermeable surface attached to one of the front or back surfaces of the plate, the impermeable surface comprising:

an opening that aligns with an opening in the one of the front or back surfaces and through which the first liquid flows;

an overlaying permeable membrane that is attached at its periphery to the impermeable surface, the attached periphery encompassing the opening through which the first liquid flows, the permeable membrane being in contact with the first gas stream; and a cooled or heated surface in contact with the impermeable surface.

* * * * *